US008627554B1

(12) United States Patent
Hagan et al.

(10) Patent No.: US 8,627,554 B1
(45) Date of Patent: Jan. 14, 2014

(54) BUCKLE ASSEMBLIES WITH SWIVEL AND DUAL RELEASE FEATURES AND ASSOCIATED METHODS OF USE AND MANUFACTURE

(75) Inventors: Willard F. Hagan, Phoenix, AZ (US); Todd J. Humbert, Chandler, AZ (US); David T. Merrill, Scottsdale, AZ (US); Michael J. Walton, Phoenix, AZ (US)

(73) Assignee: AmSafe, Inc. (Phoenix Group), Phoenix, AZ (US)

( * ) Notice: Subject to any disclaimer, the term of this patent is extended or adjusted under 35 U.S.C. 154(b) by 190 days.

(21) Appl. No.: 13/097,862

(22) Filed: Apr. 29, 2011

Related U.S. Application Data

(60) Provisional application No. 61/330,791, filed on May 3, 2010.

(51) Int. Cl.
*A44B 19/00* (2006.01)

(52) U.S. Cl.
USPC ..... 24/630; 24/579.11; 24/604; 24/DIG. 51; 24/DIG. 52

(58) Field of Classification Search
None
See application file for complete search history.

(56) References Cited

U.S. PATENT DOCUMENTS

| | | | |
|---|---|---|---|
| 906,045 | A | 12/1908 | Martin |
| 1,079,080 | A | 11/1913 | Ward |
| 1,369,456 | A | 2/1921 | Meredith |
| 1,438,898 | A | 12/1922 | Carpmill |
| 1,816,262 | A | 7/1931 | Ritter |
| 1,930,378 | A | 10/1933 | Beagan |
| 2,132,556 | A | 10/1938 | Blackshaw |
| 2,372,557 | A | 3/1945 | Dowd |
| 2,437,585 | A | 3/1948 | Zimmern |
| 2,482,693 | A | 9/1949 | Rogers et al. |
| 2,538,641 | A | 1/1951 | Elsner |
| 2,549,841 | A | 4/1951 | Morrow et al. |
| 2,639,852 | A | 5/1953 | Sanders et al. |
| 2,641,813 | A | 6/1953 | Loxham |
| 2,710,999 | A | 6/1955 | Davis |
| 2,763,451 | A | 9/1956 | Moran |

(Continued)

FOREIGN PATENT DOCUMENTS

| | | |
|---|---|---|
| CA | 2038505 | 9/1991 |
| CA | 2091526 | 10/1993 |

(Continued)

OTHER PUBLICATIONS

Britax, "COMPAQ: Convertible Car Seats." Buckle Image. Accessed Oct. 12, 2010. (2 pages). This has been publicly available for at least one year prior to this application's filing date.

(Continued)

*Primary Examiner* — Jack W. Lavinder
(74) *Attorney, Agent, or Firm* — Perkins Coie LLP

(57) ABSTRACT

Buckle assemblies with swivel and dual release features and associated systems and methods are disclosed herein. In one embodiment, a buckle assembly is configured to detachably engage a web connector coupled to a first web. The buckle assembly includes a support structure coupled to a first release actuator, a second release actuator, and a swivel sub-assembly. The buckle assembly is configured to allow a user to detach the web connector from the buckle assembly via the first and/or second release actuators. Moreover, the swivel subassembly is configured to be coupled to a second web and to prevent the second web from twisting with reference to the buckle assembly.

24 Claims, 15 Drawing Sheets

(56) References Cited

U.S. PATENT DOCUMENTS

| | | | |
|---|---|---|---|
| 2,803,864 | A | 8/1957 | Bishaf |
| 2,845,233 | A | 7/1958 | Wrighton |
| 2,846,745 | A | 8/1958 | Lathrop |
| 2,869,200 | A | 1/1959 | Phillips et al. |
| 2,876,516 | A | 3/1959 | Cummings |
| 2,892,232 | A | 6/1959 | Quilter |
| 2,893,088 | A | 7/1959 | Harper et al. |
| 2,899,732 | A | 8/1959 | Cushman |
| 2,901,794 | A | 9/1959 | Prete, Jr. |
| 2,938,254 | A | 5/1960 | Gaylord |
| 2,964,815 | A | 12/1960 | Sereno |
| 2,965,942 | A | 12/1960 | Carter |
| 3,029,487 | A | 4/1962 | Asai |
| 3,084,411 | A | 4/1963 | Lindblad |
| 3,091,010 | A | 5/1963 | Davis |
| 3,104,440 | A | 9/1963 | Davis |
| 3,110,071 | A | 11/1963 | Higuchi |
| 3,118,208 | A | 1/1964 | Wexler |
| 3,137,907 | A | 6/1964 | Unai |
| D198,566 | S | 7/1964 | Holmberg et al. |
| 3,142,103 | A | 7/1964 | Lindblad |
| 3,145,442 | A | 8/1964 | Brown |
| 3,165,805 | A | 1/1965 | Lower |
| 3,178,226 | A | 4/1965 | Lorwin |
| 3,179,992 | A | 4/1965 | Murphy, Sr. |
| 3,183,568 | A | 5/1965 | Gaylord |
| 3,189,963 | A | 6/1965 | Warner et al. |
| 3,218,685 | A | 11/1965 | Atumi |
| 3,226,791 | A | 1/1966 | Carter |
| 3,233,941 | A | 2/1966 | Selzer |
| 3,256,576 | A | 6/1966 | Klove, Jr. et al. |
| 3,262,169 | A | 7/1966 | Jantzen |
| 3,287,062 | A | 11/1966 | Board |
| 3,289,261 | A | 12/1966 | Davis |
| 3,293,713 | A | 12/1966 | Gaylord |
| 3,306,662 | A | 2/1967 | Finnigan |
| 3,312,502 | A | 4/1967 | Coe |
| 3,369,842 | A | 2/1968 | Adams et al. |
| 3,380,776 | A | 4/1968 | Dillender |
| 3,414,947 | A | 12/1968 | Holmberg et al. |
| 3,428,029 | A | 2/1969 | Kilcikstein |
| 3,451,720 | A | 6/1969 | Makinen |
| 3,491,414 | A | 1/1970 | Stoffel |
| 3,505,711 | A | 4/1970 | Carter |
| 3,523,342 | A | 8/1970 | Spires |
| D218,589 | S | 9/1970 | Lorhr et al. |
| 3,564,672 | A | 2/1971 | McIntyre |
| 3,576,056 | A | 4/1971 | Barcus |
| 3,591,900 | A | 7/1971 | Brown |
| 3,605,207 | A | 9/1971 | Glauser et al. |
| 3,605,210 | A | 9/1971 | Lohr |
| 3,631,571 | A | 1/1972 | Stoffel |
| 3,639,948 | A | 2/1972 | Sherman |
| 3,644,967 | A | 2/1972 | Romanzi, Jr. et al. |
| 3,648,333 | A | 3/1972 | Stoffel |
| 3,658,281 | A | 4/1972 | Gaylord |
| 3,673,645 | A | 7/1972 | Burleigh et al. |
| 3,678,542 | A | 7/1972 | Prete, Jr. |
| 3,695,696 | A | 10/1972 | Lohr et al. |
| 3,714,684 | A | 2/1973 | Gley |
| 3,744,102 | A | 7/1973 | Gaylord |
| 3,744,103 | A | 7/1973 | Gaylord |
| 3,760,464 | A | 9/1973 | Higuchi |
| 3,766,611 | A | 10/1973 | Gaylord |
| 3,766,612 | A | 10/1973 | Hattori |
| 3,775,813 | A | 12/1973 | Higuchi |
| 3,825,979 | A | 7/1974 | Jakob |
| 3,827,716 | A | 8/1974 | Vaughn et al. |
| 3,856,351 | A | 12/1974 | Garveys |
| 3,879,810 | A | 4/1975 | Prete, Jr. et al. |
| 3,898,715 | A | 8/1975 | Balder |
| 3,935,618 | A | 2/1976 | Fohl et al. |
| 3,964,138 | A | 6/1976 | Gaylord |
| 3,986,234 | A | 10/1976 | Frost et al. |
| 3,995,885 | A | 12/1976 | Plesniarski |
| 4,018,399 | A | 4/1977 | Rex |
| 4,026,245 | A | 5/1977 | Arthur |
| 4,051,743 | A | 10/1977 | Gaylord |
| 4,095,313 | A | 6/1978 | Piljay et al. |
| D248,618 | S | 7/1978 | Anthony |
| 4,100,657 | A | 7/1978 | Minolla et al. |
| 4,118,833 | A | 10/1978 | Knox et al. |
| 4,128,924 | A | 12/1978 | Happel et al. |
| 4,136,422 | A | 1/1979 | Ivanov et al. |
| 4,148,224 | A | 4/1979 | Craig |
| 4,181,832 | A | 1/1980 | Ueda |
| 4,184,234 | A | 1/1980 | Anthony et al. |
| 4,185,363 | A | 1/1980 | David |
| 4,196,500 | A | 4/1980 | Happel et al. |
| 4,220,294 | A | 9/1980 | DiPaola |
| 4,228,567 | A | 10/1980 | Ikesue et al. |
| 4,239,260 | A | 12/1980 | Hollowell |
| 4,253,623 | A | 3/1981 | Steger et al. |
| 4,262,396 | A | 4/1981 | Koike |
| 4,273,301 | A | 6/1981 | Frankila |
| 4,302,049 | A | 11/1981 | Simpson |
| 4,317,263 | A | 3/1982 | Fohl |
| 4,321,734 | A | 3/1982 | Gandelman |
| 4,334,341 | A | 6/1982 | Krautz et al. |
| 4,336,636 | A | 6/1982 | Ishiguro et al. |
| 4,366,604 | A | 1/1983 | Anthony et al. |
| 4,385,425 | A | 5/1983 | Tanaka et al. |
| 4,408,374 | A | 10/1983 | Fohl et al. |
| 4,419,874 | A | 12/1983 | Brentini |
| 4,425,688 | A | 1/1984 | Anthony et al. |
| 4,457,052 | A | 7/1984 | Hauber |
| 4,487,454 | A | 12/1984 | Biller |
| 4,491,343 | A | 1/1985 | Fohl |
| 4,525,901 | A | 7/1985 | Krauss |
| 4,545,097 | A | 10/1985 | Wier et al. |
| 4,549,769 | A | 10/1985 | Pilarski |
| 4,555,831 | A * | 12/1985 | Otzen et al. ..... 24/603 |
| 4,569,535 | A | 2/1986 | Haglund et al. |
| D285,383 | S | 9/1986 | Anthony |
| 4,617,705 | A | 10/1986 | Anthony et al. |
| 4,637,102 | A | 1/1987 | Teder et al. |
| 4,638,533 | A | 1/1987 | Gloomis et al. |
| 4,640,550 | A | 2/1987 | Hakansson et al. |
| 4,644,618 | A | 2/1987 | Holmberg et al. |
| 4,646,400 | A | 3/1987 | Tanaka |
| 4,648,483 | A | 3/1987 | Skyba |
| 4,650,214 | A | 3/1987 | Higbee |
| 4,651,946 | A | 3/1987 | Anthony et al. |
| 4,656,700 | A | 4/1987 | Tanaka et al. |
| 4,660,889 | A | 4/1987 | Anthony et al. |
| 4,679,852 | A | 7/1987 | Anthony et al. |
| 4,682,791 | A | 7/1987 | Ernst |
| 4,685,176 | A | 8/1987 | Burnside |
| 4,692,970 | A | 9/1987 | Anthony et al. |
| 4,711,003 | A | 12/1987 | Gelula |
| 4,716,630 | A | 1/1988 | Skyba |
| 4,720,148 | A | 1/1988 | Anthony et al. |
| 4,726,625 | A | 2/1988 | Bougher |
| 4,727,628 | A | 3/1988 | Rudholm et al. |
| 4,733,444 | A | 3/1988 | Takada |
| 4,738,485 | A | 4/1988 | Rumpf |
| 4,741,574 | A | 5/1988 | Weightman et al. |
| 4,742,604 | A | 5/1988 | Mazelsky |
| D296,678 | S | 7/1988 | Lortz et al. |
| 4,757,579 | A | 7/1988 | Nishino et al. |
| 4,758,048 | A | 7/1988 | Shuman |
| 4,766,654 | A | 8/1988 | Sugimoto |
| 4,786,078 | A | 11/1988 | Schreier et al. |
| 4,790,597 | A | 12/1988 | Bauer et al. |
| 4,809,409 | A | 3/1989 | Van Riesen |
| 4,832,410 | A | 5/1989 | Bougher |
| 4,843,688 | A | 7/1989 | Ikeda et al. |
| 4,854,607 | A | 8/1989 | Mandracchia et al. |
| 4,854,608 | A | 8/1989 | Barral et al. |
| D303,232 | S | 9/1989 | Lortz et al. |
| 4,876,770 | A | 10/1989 | Bougher |
| 4,876,772 | A | 10/1989 | Anthony et al. |
| 4,884,652 | A | 12/1989 | Vollmer |
| 4,911,377 | A | 3/1990 | Lortz et al. |

(56) References Cited

U.S. PATENT DOCUMENTS

| | | | |
|---|---|---|---|
| 4,919,484 | A | 4/1990 | Bougher et al. |
| 4,927,211 | A | 5/1990 | Bolcerek |
| 4,934,030 | A | 6/1990 | Spinosa et al. |
| 4,940,254 | A | 7/1990 | Ueno et al. |
| 4,942,649 | A | 7/1990 | Anthony et al. |
| 4,995,640 | A | 2/1991 | Saito et al. |
| 5,015,010 | A | 5/1991 | Homeier et al. |
| 5,023,981 | A | 6/1991 | Anthony et al. |
| 5,026,093 | A | 6/1991 | Nishikaji |
| 5,029,369 | A | 7/1991 | Oberhardt et al. |
| 5,031,962 | A | 7/1991 | Lee |
| 5,038,446 | A | 8/1991 | Anthony et al. |
| 5,039,169 | A | 8/1991 | Bougher et al. |
| 5,046,687 | A | 9/1991 | Herndon |
| 5,054,815 | A | 10/1991 | Gavagan |
| 5,067,212 | A | 11/1991 | Ellis |
| 5,074,011 | A | 12/1991 | Carlson |
| 5,074,588 | A | 12/1991 | Huspen |
| 5,084,946 | A | 2/1992 | Lee |
| 5,088,160 | A | 2/1992 | Warrick |
| 5,088,163 | A | 2/1992 | van Riesen |
| 5,097,572 | A | 3/1992 | Warrick |
| D327,455 | S | 6/1992 | Blair |
| 5,119,532 | A | 6/1992 | Tanaka |
| 5,123,147 | A | 6/1992 | Blair |
| 5,123,673 | A | 6/1992 | Tame |
| 5,142,748 | A | 9/1992 | Anthony et al. |
| 5,159,732 | A | 11/1992 | Burke |
| 5,160,186 | A | 11/1992 | Lee |
| 5,170,539 | A | 12/1992 | Lundstedt et al. |
| D332,433 | S | 1/1993 | Bougher |
| 5,176,402 | A | 1/1993 | Coulon |
| 5,182,837 | A | 2/1993 | Anthony et al. |
| 5,219,206 | A | 6/1993 | Anthony et al. |
| 5,219,207 | A | 6/1993 | Anthony et al. |
| 5,220,713 | A | 6/1993 | Lane, Jr. et al. |
| D338,119 | S | 8/1993 | Merrick |
| 5,234,181 | A | 8/1993 | Schroth |
| 5,236,220 | A | 8/1993 | Mills |
| 5,248,187 | A | 9/1993 | Harrison |
| D342,465 | S | 12/1993 | Anthony et al. |
| 5,267,377 | A | 12/1993 | Gillis et al. |
| 5,269,051 | A | 12/1993 | McFalls |
| 5,272,770 | A | 12/1993 | Allen et al. |
| 5,282,672 | A | 2/1994 | Borlinghaus |
| 5,282,706 | A | 2/1994 | Anthony et al. |
| 5,283,933 | A | 2/1994 | Wiseman et al. |
| 5,286,057 | A | 2/1994 | Forster |
| 5,286,090 | A | 2/1994 | Templin et al. |
| 5,292,181 | A | 3/1994 | Dybro |
| 5,301,371 | A | 4/1994 | Chao |
| 5,308,148 | A | 5/1994 | Peterson et al. |
| 5,311,653 | A | 5/1994 | Merrick |
| 5,350,195 | A | 9/1994 | Brown |
| 5,350,196 | A | 9/1994 | Atkins |
| 5,369,855 | A | 12/1994 | Tokugawa |
| 5,370,333 | A | 12/1994 | Lortz et al. |
| 5,375,879 | A | 12/1994 | Williams et al. |
| 5,380,066 | A | 1/1995 | Wiseman et al. |
| 5,392,535 | A | 2/1995 | Van Noy et al. |
| 5,397,171 | A | 3/1995 | Leach |
| 5,403,038 | A | 4/1995 | McFalls |
| 5,406,681 | A | 4/1995 | Olson |
| 5,411,292 | A | 5/1995 | Collins et al. |
| D359,710 | S | 6/1995 | Chinni et al. |
| 5,432,987 | A | 7/1995 | Schroth |
| 5,435,272 | A | 7/1995 | Epstein |
| 5,443,302 | A | 8/1995 | Dybro |
| 5,451,094 | A | 9/1995 | Templin et al. |
| D364,124 | S | 11/1995 | Lortz et al. |
| 5,471,714 | A | 12/1995 | Olson |
| 5,495,646 | A | 3/1996 | Scrutchfield et al. |
| 5,497,956 | A | 3/1996 | Crook |
| 5,511,856 | A | 4/1996 | Merrick et al. |
| 5,516,199 | A | 5/1996 | Crook et al. |
| 5,526,556 | A | 6/1996 | Czank |
| 5,540,403 | A | 7/1996 | Standley |
| 5,560,565 | A | 10/1996 | Merrick et al. |
| 5,561,891 | A | 10/1996 | Hsieh |
| 5,566,431 | A | 10/1996 | Haglund |
| 5,568,676 | A | 10/1996 | Freeman |
| 5,570,933 | A | 11/1996 | Rouhana et al. |
| 5,579,785 | A | 12/1996 | Bell |
| 5,584,107 | A | 12/1996 | Koyanagi et al. |
| 5,588,189 | A | 12/1996 | Gorman et al. |
| 5,606,783 | A | 3/1997 | Gillis et al. |
| 5,622,327 | A | 4/1997 | Heath et al. |
| 5,628,548 | A | 5/1997 | Lacoste |
| 5,634,664 | A | 6/1997 | Seki et al. |
| 5,669,572 | A | 9/1997 | Crook |
| 5,695,243 | A | 12/1997 | Anthony et al. |
| 5,699,594 | A | 12/1997 | Czank et al. |
| D389,426 | S | 1/1998 | Merrick et al. |
| 5,722,689 | A | 3/1998 | Chen et al. |
| 5,743,597 | A | 4/1998 | Jessup et al. |
| 5,765,774 | A | 6/1998 | Maekawa et al. |
| 5,774,947 | A | 7/1998 | Anscher |
| 5,779,319 | A | 7/1998 | Merrick |
| D397,063 | S | 8/1998 | Woellert et al. |
| 5,788,281 | A | 8/1998 | Yanagi et al. |
| 5,788,282 | A | 8/1998 | Lewis |
| 5,794,878 | A | 8/1998 | Carpenter et al. |
| 5,813,097 | A | 9/1998 | Woellert et al. |
| 5,839,793 | A | 11/1998 | Merrick et al. |
| 5,857,247 | A | 1/1999 | Warrick et al. |
| 5,873,599 | A | 2/1999 | Bauer et al. |
| 5,873,635 | A | 2/1999 | Merrick |
| 5,882,084 | A | 3/1999 | Verellen et al. |
| D407,667 | S | 4/1999 | Homeier |
| 5,908,223 | A | 6/1999 | Miller |
| 5,915,630 | A | 6/1999 | Step |
| 5,928,300 | A | 7/1999 | Rogers et al. |
| 5,934,760 | A | 8/1999 | Schroth |
| D416,827 | S | 11/1999 | Anthony et al. |
| 5,979,026 | A | 11/1999 | Anthony |
| 5,979,982 | A | 11/1999 | Nakagawa |
| 5,996,192 | A | 12/1999 | Haines et al. |
| 6,003,899 | A | 12/1999 | Chaney |
| 6,017,087 | A | 1/2000 | Anthony et al. |
| 6,056,320 | A | 5/2000 | Khalifa et al. |
| 6,065,367 | A | 5/2000 | Schroth |
| 6,065,777 | A | 5/2000 | Merrick |
| 6,123,388 | A | 9/2000 | Vits et al. |
| 6,182,783 | B1 | 2/2001 | Bayley |
| RE37,123 | E | 4/2001 | Templin et al. |
| 6,224,154 | B1 | 5/2001 | Stoki |
| 6,230,370 | B1 | 5/2001 | Nelsen |
| 6,260,884 | B1 | 7/2001 | Bittner et al. |
| 6,295,700 | B1 | 10/2001 | Plzak |
| 6,309,024 | B1 | 10/2001 | Busch |
| 6,312,015 | B1 | 11/2001 | Merrick et al. |
| 6,315,232 | B1 | 11/2001 | Merrick |
| 6,322,140 | B1 | 11/2001 | Jessup et al. |
| 6,322,149 | B1 | 11/2001 | Conforti et al. |
| 6,325,412 | B1 | 12/2001 | Pan |
| 6,328,379 | B1 | 12/2001 | Merrick et al. |
| 6,343,841 | B1 | 2/2002 | Gregg et al. |
| 6,357,790 | B1 | 3/2002 | Swann et al. |
| 6,363,591 | B1 | 4/2002 | Bell et al. |
| 6,367,882 | B1 | 4/2002 | Van Druff et al. |
| 6,374,168 | B1 | 4/2002 | Fujii |
| 6,400,145 | B1 | 6/2002 | Chamings et al. |
| 6,412,863 | B1 | 7/2002 | Merrick et al. |
| 6,418,596 | B2 | 7/2002 | Haas |
| 6,425,632 | B1 | 7/2002 | Anthony et al. |
| 6,442,807 | B1 | 9/2002 | Adkisson |
| 6,446,272 | B1 | 9/2002 | Lee |
| 6,463,638 | B1 | 10/2002 | Pontaoe |
| 6,467,849 | B1 | 10/2002 | Deptolla |
| 6,485,057 | B1 | 11/2002 | Midorikawa et al. |
| 6,485,098 | B1 | 11/2002 | Vits et al. |
| 6,508,515 | B2 | 1/2003 | Vits et al. |
| 6,513,208 | B1 | 2/2003 | Sack et al. |
| 6,520,392 | B2 | 2/2003 | Thibodeau et al. |

(56) References Cited

U.S. PATENT DOCUMENTS 6,543,101 B2 4/2003 Sack et al.
6,547,273 B2 4/2003 Grace et al.
6,560,825 B2 5/2003 Maciejczyk
6,566,869 B2 5/2003 Chamings et al.
6,588,077 B2 7/2003 Katsuyama et al.
6,592,149 B2 7/2003 Sessoms
6,606,770 B1 8/2003 Badrenas Buscart
6,619,753 B2 9/2003 Takayama
6,631,926 B2 10/2003 Merrick et al.
6,665,912 B2 12/2003 Turner et al.
6,694,577 B2 2/2004 Di Perrero
6,711,790 B2 3/2004 Pontaoe
6,719,233 B2 4/2004 Specht et al.
6,719,326 B2 4/2004 Schroth et al.
6,722,601 B2 4/2004 Kohlndorfer et al.
6,722,697 B2 4/2004 Krauss et al.
6,733,041 B2 5/2004 Arnold et al.
6,739,541 B2 5/2004 Palliser et al.
6,749,150 B2 6/2004 Kohlndorfer et al.
6,763,557 B2 7/2004 Steiff et al.
6,769,157 B1 8/2004 Meal
6,786,294 B2 9/2004 Specht
6,786,510 B2 9/2004 Roychoudhury et al.
6,786,511 B2 9/2004 Heckmayr
6,793,291 B1 9/2004 Kocher
6,796,007 B1 9/2004 Anscher
6,802,470 B2 10/2004 Smithson et al.
6,820,310 B2 11/2004 Woodard et al.
6,820,902 B2 11/2004 Kim
6,834,822 B2 12/2004 Koning et al.
6,836,754 B2 12/2004 Cooper
6,840,544 B2 1/2005 Prentkowski
6,851,160 B2 2/2005 Carver
6,857,326 B2 2/2005 Specht et al.
6,860,671 B2 3/2005 Schulz
6,863,235 B2 3/2005 Koning et al.
6,863,236 B2 3/2005 Kempf et al.
6,868,585 B2 3/2005 Anthony et al.
6,868,591 B2 3/2005 Dingman et al.
6,871,876 B2 3/2005 Xu
6,874,819 B2 4/2005 O'Neill
6,882,914 B2 4/2005 Gioutsos et al.
6,886,889 B2 5/2005 Vits et al.
6,896,291 B1 5/2005 Peterson
6,902,193 B2 6/2005 Kim et al.
6,913,288 B2 7/2005 Schulz et al.
6,916,045 B2 7/2005 Clancy, III et al.
6,921,136 B2 7/2005 Bell et al.
6,922,875 B2 8/2005 Sato et al.
6,931,669 B2 8/2005 Ashline
6,935,701 B1 8/2005 Arnold et al.
6,951,350 B2 10/2005 Heidorn et al.
6,957,789 B2 10/2005 Bowman et al.
6,959,946 B2 11/2005 Desmarais et al.
6,962,394 B2 11/2005 Anthony et al.
6,966,518 B2 11/2005 Kohlndorfer et al.
6,969,022 B2 11/2005 Bell et al.
6,969,122 B2 11/2005 Sachs et al.
6,993,436 B2 1/2006 Specht et al.
6,997,474 B2 2/2006 Midorikawa et al.
6,997,479 B2 2/2006 Desmarais et al.
7,010,836 B2 3/2006 Acton et al.
D519,406 S 4/2006 Merrill et al.
7,025,297 B2 4/2006 Bell et al.
7,029,067 B2 4/2006 Vits et al.
7,040,696 B2 5/2006 Vits et al.
7,073,866 B1 7/2006 Berdahl
7,077,475 B2 7/2006 Boyle
7,080,856 B2 7/2006 Desmarais et al.
7,100,991 B2 9/2006 Schroth
7,108,114 B2 9/2006 Mori et al.
7,118,133 B2 10/2006 Bell et al.
7,131,667 B2 11/2006 Bell et al.
7,137,648 B2 11/2006 Schulz et al.
7,137,650 B2 11/2006 Bell et al.
7,140,571 B2 11/2006 Hishon et al.
7,144,085 B2 12/2006 Vits et al.
7,147,251 B2 12/2006 Bell et al.
D535,214 S 1/2007 Kolasa
7,159,285 B2 1/2007 Karlsson
7,180,258 B2 2/2007 Specht et al.
7,182,370 B2 2/2007 Arnold
7,210,707 B2 5/2007 Schroth
7,216,827 B2 5/2007 Tanaka et al.
7,219,929 B2 5/2007 Bell et al.
7,232,154 B2 6/2007 Desmarais et al.
7,237,741 B2 7/2007 Specht
7,240,405 B2 7/2007 Webber et al.
7,240,924 B2 7/2007 Kohlndorfer et al.
7,246,854 B2 7/2007 Dingman et al.
7,263,750 B2 9/2007 Keene et al.
7,278,684 B2 10/2007 Boyle
D555,358 S 11/2007 King
7,300,013 B2 11/2007 Morgan et al.
7,341,216 B2 3/2008 Heckmayr
7,360,287 B2 4/2008 Cerruti et al.
7,367,590 B2 5/2008 Koning et al.
7,377,464 B2 5/2008 Morgan
7,384,014 B2 6/2008 Ver Hoven et al.
7,395,585 B2 7/2008 Longley et al.
7,404,239 B1 7/2008 Walton et al.
7,407,193 B2 8/2008 Yamaguchi et al.
D578,931 S 10/2008 Toltzman et al.
7,452,003 B2 11/2008 Bell
7,455,256 B2 11/2008 Morgan
7,461,866 B2 12/2008 Desmarais et al.
7,475,840 B2 1/2009 Heckmayr
7,477,139 B1 1/2009 Cuevas
7,481,399 B2 1/2009 Nohren et al.
7,506,413 B2 3/2009 Dingman et al.
7,516,808 B2 4/2009 Tanaka
7,520,036 B1 4/2009 Baldwin et al.
D592,543 S 5/2009 Kolasa
7,533,902 B2 5/2009 Arnold et al.
7,547,043 B2 6/2009 Kokeguchi et al.
7,614,124 B2 11/2009 Keene et al.
7,631,830 B2 12/2009 Boelstler et al.
7,669,794 B2 3/2010 Boelstler et al.
7,673,945 B1 3/2010 Riffel et al.
7,698,791 B2 4/2010 Pezza
7,722,081 B2 5/2010 Van Druff et al.
7,739,019 B2 6/2010 Robert et al.
7,753,410 B2 7/2010 Coultrup
7,775,557 B2 8/2010 Bostrom et al.
RE41,790 E 10/2010 Stanley
7,861,341 B2 1/2011 Ayette et al.
7,862,124 B2 1/2011 Dingman
D632,611 S 2/2011 Buscart
D637,518 S 5/2011 Chen
7,934,775 B2 5/2011 Walker et al.
7,945,975 B2 5/2011 Thomas et al.
8,011,730 B2 9/2011 Greenwood
8,096,027 B2 1/2012 Jung et al.
8,240,012 B2 * 8/2012 Walega et al. ..... 24/603
8,240,767 B2 8/2012 Greenwood
2002/0089163 A1 7/2002 Bedewi et al.
2002/0135175 A1 9/2002 Schroth
2002/0145279 A1 10/2002 Murray
2003/0015863 A1 1/2003 Brown et al.
2003/0027917 A1 2/2003 Namiki et al.
2003/0085608 A1 5/2003 Girardin
2004/0084953 A1 5/2004 Hansen
2004/0169411 A1 9/2004 Murray
2004/0174063 A1 9/2004 Kocher
2004/0217583 A1 11/2004 Wang
2004/0227390 A1 11/2004 Schroth
2004/0251367 A1 12/2004 Suzuki et al.
2005/0017567 A1 1/2005 Sachs et al.
2005/0073187 A1 4/2005 Frank et al.
2005/0107932 A1 5/2005 Bolz et al.
2005/0127660 A1 6/2005 Liu
2005/0179244 A1 8/2005 Schroth
2005/0206151 A1 9/2005 Ashline
2005/0284977 A1 12/2005 Specht et al.

(56) References Cited

U.S. PATENT DOCUMENTS

| | | | |
|---|---|---|---|
| 2006/0071535 | A1 | 4/2006 | Kim et al. |
| 2006/0075609 | A1 | 4/2006 | Dingman et al. |
| 2006/0097095 | A1 | 5/2006 | Boast |
| 2006/0237573 | A1 | 10/2006 | Boelstler et al. |
| 2006/0243070 | A1 | 11/2006 | Van Druff et al. |
| 2006/0267394 | A1 | 11/2006 | David et al. |
| 2006/0277727 | A1 | 12/2006 | Keene et al. |
| 2007/0080528 | A1 | 4/2007 | Itoga et al. |
| 2007/0241549 | A1 | 10/2007 | Boelstler et al. |
| 2007/0257480 | A1 | 11/2007 | Van Druff et al. |
| 2008/0018156 | A1 | 1/2008 | Hammarskjold et al. |
| 2008/0054615 | A1 | 3/2008 | Coultrup |
| 2008/0093833 | A1 | 4/2008 | Odate |
| 2008/0100051 | A1 | 5/2008 | Bell et al. |
| 2008/0100122 | A1 | 5/2008 | Bell et al. |
| 2008/0136246 | A1 | 6/2008 | Salter |
| 2008/0172847 | A1 | 7/2008 | Keene et al. |
| 2008/0224460 | A1 | 9/2008 | Erez |
| 2009/0014991 | A1 | 1/2009 | Smyth et al. |
| 2009/0069983 | A1 | 3/2009 | Humbert et al. |
| 2009/0183348 | A1 | 7/2009 | Walton et al. |
| 2009/0212549 | A1 | 8/2009 | Jones |
| 2009/0241305 | A1 | 10/2009 | Buckingham |
| 2010/0115737 | A1 | 5/2010 | Foubert |
| 2010/0125983 | A1 | 5/2010 | Keene et al. |
| 2010/0146749 | A1 | 6/2010 | Jung |
| 2010/0213753 | A1 | 8/2010 | Humbert |
| 2010/0219667 | A1 | 9/2010 | Merrill et al. |
| 2011/0010901 | A1 | 1/2011 | Holler |
| 2011/0057500 | A1 | 3/2011 | Walker et al. |
| 2012/0242134 | A1 | 9/2012 | Siegel |
| 2012/0292893 | A1 | 11/2012 | Baca et al. |
| 2013/0127229 | A1 | 5/2013 | Humbert |

FOREIGN PATENT DOCUMENTS

| | | |
|---|---|---|
| CA | 2112960 | 7/1994 |
| CA | 2450744 | 2/2003 |
| DE | 4019402 | 12/1991 |
| DE | 4421688 | 12/1995 |
| DE | 69019765 | 2/1996 |
| EP | 26564 | 4/1981 |
| EP | 03630622 | 4/1990 |
| EP | 0380442 | 8/1990 |
| EP | 0401455 | 12/1990 |
| EP | 0404730 | 12/1990 |
| EP | 0449772 | 10/1991 |
| EP | 0519296 | 12/1992 |
| EP | 0561274 | 9/1993 |
| EP | 0608564 | 8/1994 |
| EP | 1153789 | 11/2001 |
| EP | 1447021 | 8/2004 |
| FR | 1298012 | 7/1962 |
| GB | 888436 | 1/1962 |
| GB | 1047761 | 11/1966 |
| GB | 1582973 | 1/1981 |
| GB | 2055952 | 3/1981 |
| GB | 2356890 | 6/2001 |
| JP | 52055120 | 5/1977 |
| JP | 63141852 | 9/1988 |
| JP | 63247150 | 10/1988 |
| JP | 10119611 | 5/1998 |
| JP | 2001138858 | 5/2001 |
| WO | WO-8603386 | 6/1986 |
| WO | WO-03009717 | 2/2003 |
| WO | WO-2004004507 | 1/2004 |
| WO | WO-2006041859 | 4/2006 |
| WO | WO-2010027853 | 3/2010 |

OTHER PUBLICATIONS

Global Seating Systems LLC, "CCOPS," Cobra: Soldier Survival System, 1 page undated. [Color Copy].

Holmbergs, "Art.No. 63/4959-XX and 63/4958-XX GR.1 Buckle, 3/5 point." Accessed Sep. 15, 2010. www.holmbergs.se. (2 pages).

Holmbergs, "Gr. 0+ 3-point buckle with plastic chassi and tongues." Accessed Sep. 15, 2010. www. holmbergs.se. (1 page).

Holmbergs, "Gr. 1 Buckle, Viking." Accessed Sep. 15, 2010. www. holmbergs.se. (1 page).

Holmbergs, "Group 1 Systems." Accessed Sep. 15, 2010. www. holmbergs.se. (1 page).

Holmbergs, "Infant buckle with steel tongues." Accessed Sep. 15, 2010. www.holmbergs.se. (1 page).

Holmbergs, "Infant buckle. 5-point with plastic chassi and plastic tongues." Accessed Sep. 15, 2010. www.holmbergs.se. (1 page).

Novarace, "DL: Group 1 Buckle." Accessed Sep. 15, 2010. www. novarace.com. (1 page).

Novarace, "GT 3: Group 0 Buckle." Accessed Sep. 15, 2010. www. novarace.com (1 page).

Novarace, "GT 5: Group 0 Buckle." Accessed Sep. 15, 2010. www. novarace.com (1 page).

Novarace, "GT: Group 1 Buckle." Accessed Oct. 8, 2010. www. novarace.com. (1 page).

Novarace, "KMA 1: Group 1 Buckle." Accessed Sep. 15, 2010. www.novarace.com. (1 page).

Sabelt Catalog, "SAB104: Standard tongue hole to facilitate webbing insert," p. 23 (1 page).

Sabelt, "Daphne 0: Fiberglass-plastic buckle with metal pin latch." Accessed Sep. 15, 2010. www.sabelt.com (1 page).

Sabelt, "RO1000: Fiberglass-plastic buckle with metal pin latch." Accessed Sep. 15, 2010. www.sabelt.com (1 page).

Sabelt, "SAB004: Fiberglass-plastic buckle with metal pin latch." Accessed Sep. 15, 2010. www. sabelt.com. (1 page).

Sabelt, "SABUSA004: Fiberglass-plastic buckle with metal pin latch." Accessed Sep. 15, 2010. www.sabelt.com. (1 page).

Schroth Safety Products, Installation Instructions, HMMWV Gunner restraint, Single Lower with Swivel—M1151, Revision: A, Jul. 28, 2006, pp. 1-10.

Toltzman, Randall and Shaul, Rich; "Buckle Assembly"; U.S. Appl. No. 29/297,210, filed Nov. 6, 2007, electronic copy located at www. uspto.gov.

* cited by examiner

BUCKLE ASSEMBLIES WITH SWIVEL AND DUAL RELEASE FEATURES AND ASSOCIATED METHODS OF USE AND MANUFACTURE

CROSS-REFERENCE TO RELATED APPLICATION

The present application claims priority under 35 USC §119 (e) to U.S. Provisional Application No. 61/330,791, filed May 3, 2010, the disclosure of which is incorporated herein by reference in its entirety.

TECHNICAL FIELD

The following disclosure relates generally to personal restraint systems for use in vehicles and, more particularly, to buckle assemblies having swivel features and dual release features.

BACKGROUND

There are many types of personal restraint systems for use in automobiles, aircraft, all-terrain-vehicles, and other vehicles. Such systems include, for example, seat belts for use by adults and children of sufficient size, and child seats with associated restraints for use by toddlers and small children.

One method of securing seat belts or webs around an occupant includes releasably attaching an end portion of each of the webs to a buckle assembly. The buckle assembly retains the webs around the occupant during use, and also enables the occupant to release or separate the webs after use. Conventional buckle assemblies can be positioned to the side of an occupant or in front of an occupant. For example, a "three point" harness system, as typically found in conventional automobiles, can include a shoulder web and a lap web that are releasably secured to a buckle assembly positioned proximate to the occupant's hip. A "five point' harness system can include a crotch web, first and second shoulder webs, and first and second lap webs that are releasably secured to a buckle assembly positioned proximate to the occupant's mid-section.

DETAILED DESCRIPTION

The following disclosure describes buckle assemblies and associated web connectors for use with personal restraint systems in vehicles. As described in greater detail below, a personal restraint system configured in accordance with one aspect of the disclosure can include a buckle assembly with swiveling features and dual release features (e.g., separate release features for releasing one or more webs from the buckle assembly). Certain details are set forth in the following description and in FIGS. 1-10B to provide a thorough understanding of various embodiments of the disclosure. However, other details describing well-known structures and systems often associated with buckle assemblies, web connectors, and/or other aspects of personal restraint systems are not set forth below to avoid unnecessarily obscuring the description of various embodiments of the disclosure.

Many of the details, dimensions, angles, and other features shown in the Figures are merely illustrative of particular embodiments of the disclosure. Accordingly, other embodiments can have other details, dimensions, angles, and features without departing from the spirit or scope of the present disclosure. In addition, those of ordinary skill in the art will appreciate that further embodiments of the disclosure can be practiced without several of the details described below.

In the Figures, identical reference numbers identify identical or at least generally similar elements. To facilitate the discussion of any particular element, the most significant digit or digits of any reference number refers to the Figure in which that element is first introduced. For example, element 110 is first introduced and discussed with reference to FIG. 1.

Figure 1:
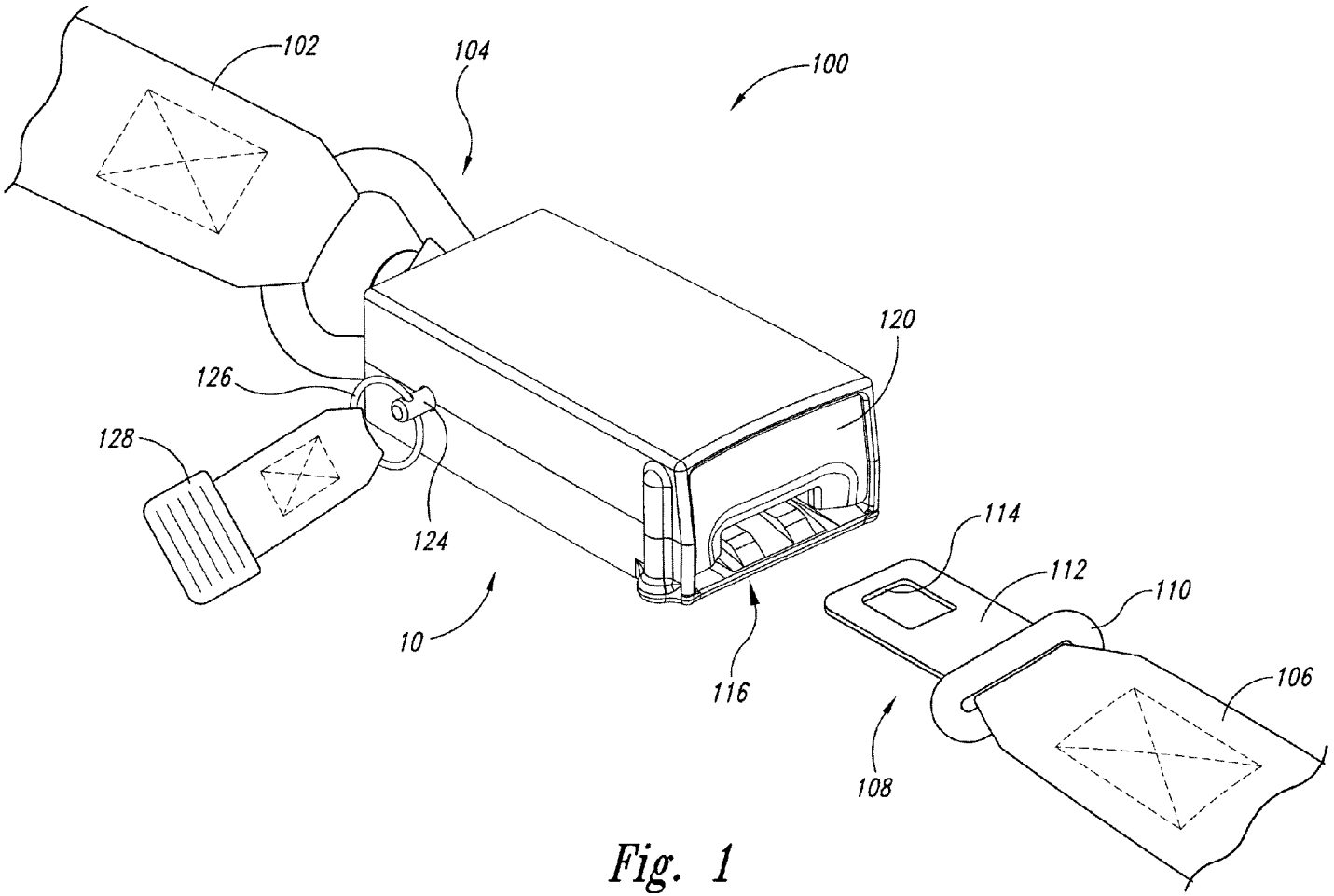
FIG. 1 is an isometric view of a portion restraint system configured in accordance with an embodiment of the disclosure.

FIG. 1 is an isometric view of a portion of a restraint system 10 configured in accordance with an embodiment of the disclosure. In the illustrated embodiment, the restraint system 10 includes a buckle assembly 100 that is operably coupled to multiple belts or webs. For example, the restraint system 10 includes a first web 102 coupled to the buckle assembly 100 with a swivel subassembly 104. The restraint system 10 also includes a second web 106 that can be releasably coupled to the buckle assembly 100 via a web connector 108. More specifically, the web connector 108 includes a web receiving portion 110 that receives the second web 106. In certain embodiments, the second web 106 can be fixedly attached to the web receiving portion 110. In other embodiments, however, the second web 106 can slidably pass through the web receiving portion 110. The first and second webs 102, 106 are configured to at least partially restrain an occupant in a vehicle.

As used herein, the term "webs" can refer to any type of flexible straps or belts, such as seat belts made from woven material known in the art for use with personal restraint systems. In certain embodiments, the webs described herein can include segments of a fixed length and/or adjustable length to accommodate different sized occupants. In a particular embodiment, the first web 102 and/or the second web 106 can be static webs. In other embodiments, however, the distal ends of the webs can be operably coupled to one or more retractors (e.g., inertial reels) to provide adjustable lengths of the webs. In addition, one of ordinary skill in the art will appreciate that the restraint system can be used with any type of vehicle including, for example, automobiles, military vehicles, aircraft, rotorcraft, watercraft, racing vehicles, etc. Moreover, the buckle assemblies described herein can be used with any type of restraint system, including, for example, personal restraints, automobile restraints, aircraft restraints, racing restraints, child restraints, parachute restraints, fall-protection restraints, aviation tie down restraints, etc. In addition, although the embodiment illustrated in FIG. 1 includes a single first web 102 coupled to the swivel sub-assembly 104 and/or a single second web 106 coupled to the web connector 108, in other embodiments multiple webs can be coupled to the swivel sub-assembly 104 and/or the web connector 108.

According to one aspect of the illustrated embodiment, and as described in detail below, the swivel subassembly 104 can be securely attached to the first web 102 and be configured to freely rotate with reference to the buckle assembly 100. As such, the swivel subassembly 104 prevents or inhibits the first web 102 and/or the second web 106 from twisting.

According to yet another aspect of the illustrated embodiment, and as described in detail below, the buckle assembly 100 includes multiple quick release mechanisms or features for detaching the connection between the buckle assembly 100 and the web connector 108. For example, the web connector 108 includes a tongue 112 with a corresponding locking feature or pawl aperture 114. When a user inserts the tongue 112 into an opening 116 in the buckle assembly 100, the buckle assembly 100 lockably engages the pawl aperture 114 of the tongue 112. To release the tongue 112 from the buckle assembly 100, a user can selectively actuate at least one of a first release actuator or button 120 and a second release actuator pull or pin 124. As described in detail below, a user can depress the release button 120 into the buckle assembly 100 to release the tongue 112. Moreover, the user can also pull the second release actuator 124 away from the buckle assembly 100 to release the tongue 112. For example, the user can grab a gripping feature or pull tab 128 that is coupled to the second release actuator 124. In the illustrated embodiment the pull tab 128 is coupled to the second release actuator 124 via a connecting ring 126. In other embodiments, however, the buckle assembly 100 can include other suitable mechanisms for providing a convenient grip or access to the second release actuator 124.

Figure 2A:
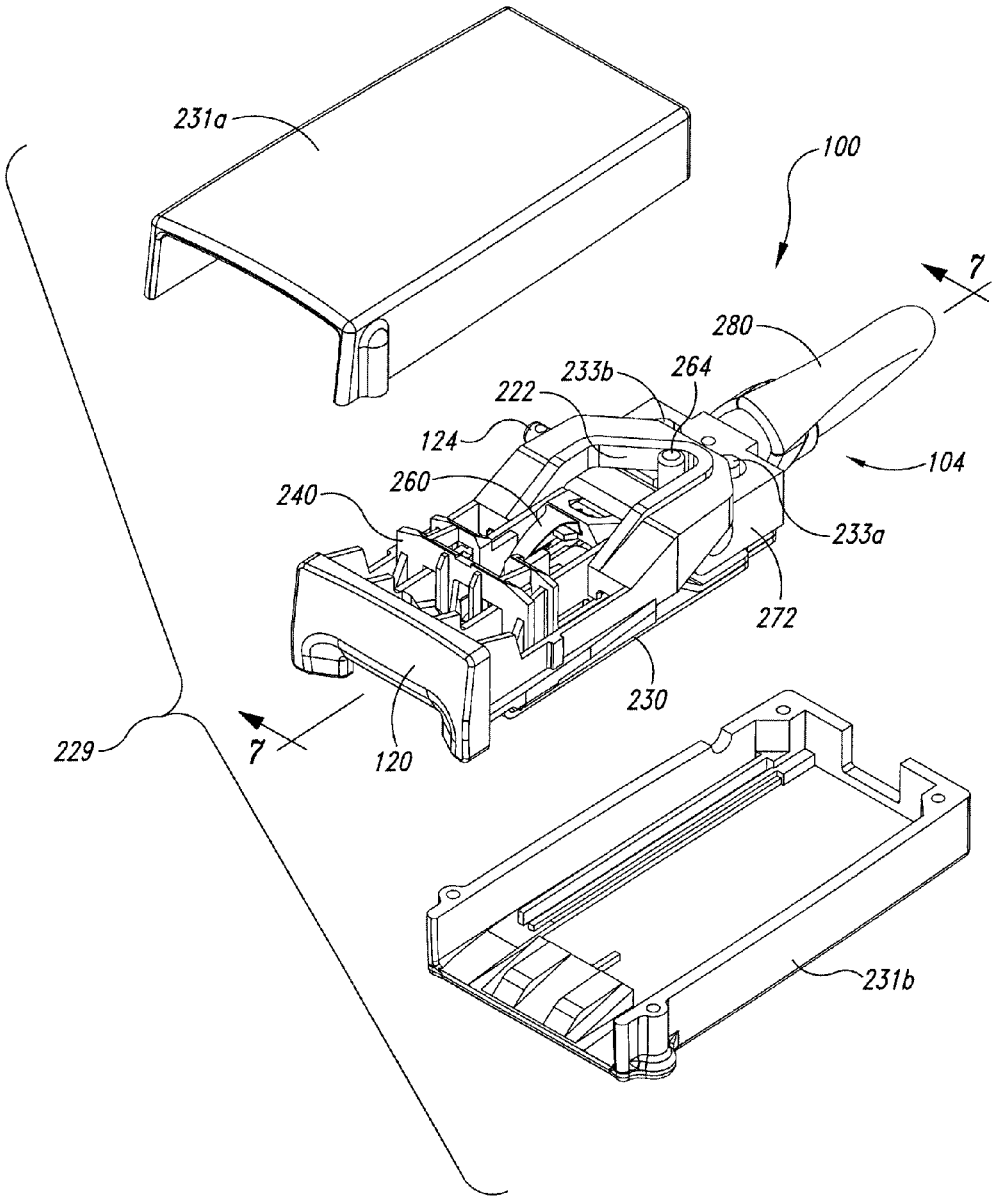
FIG. 2A is a partially exploded isometric view.
Figure 2B:
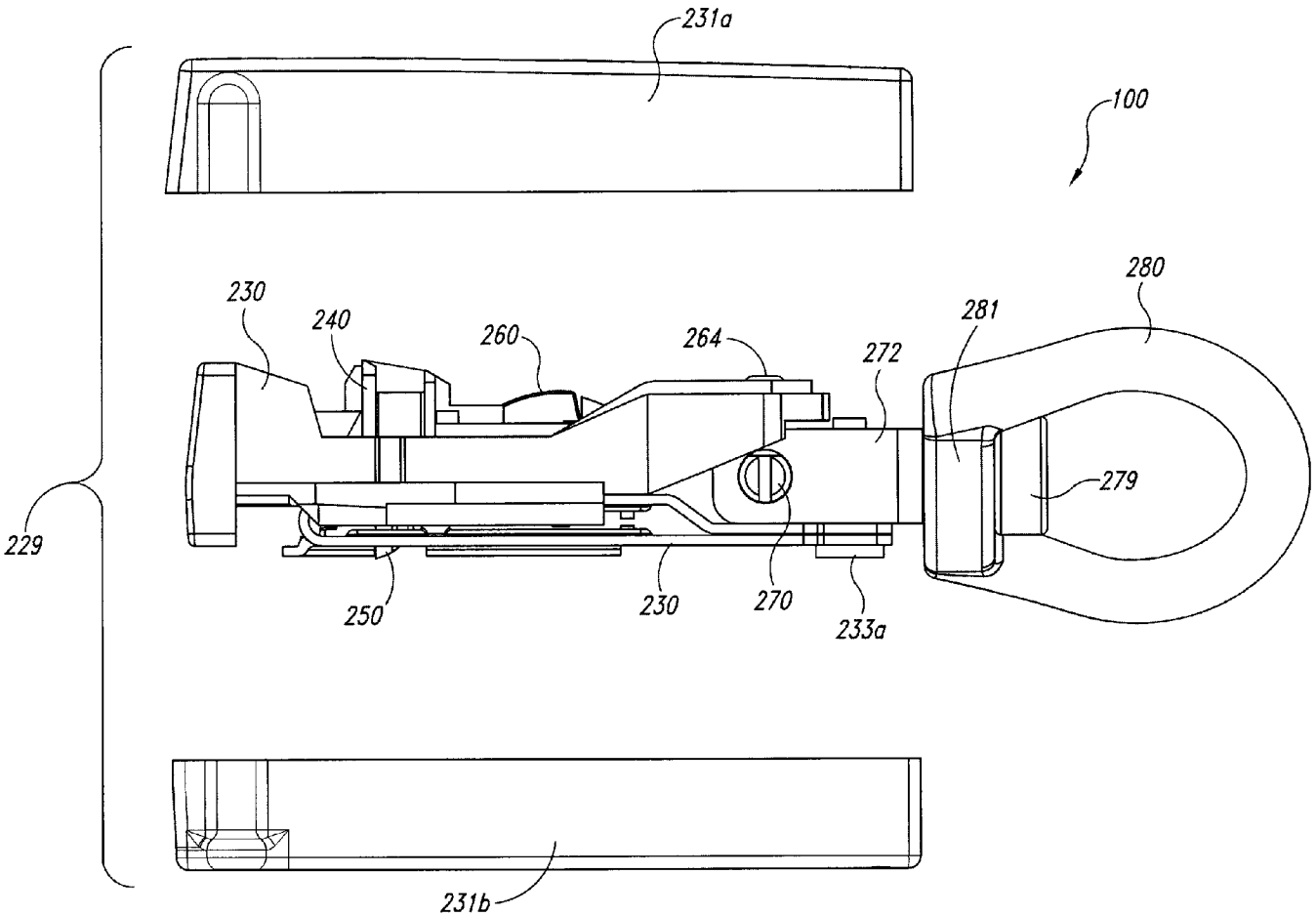
FIG. 2B is a partially exploded side view.
Figure 2C:
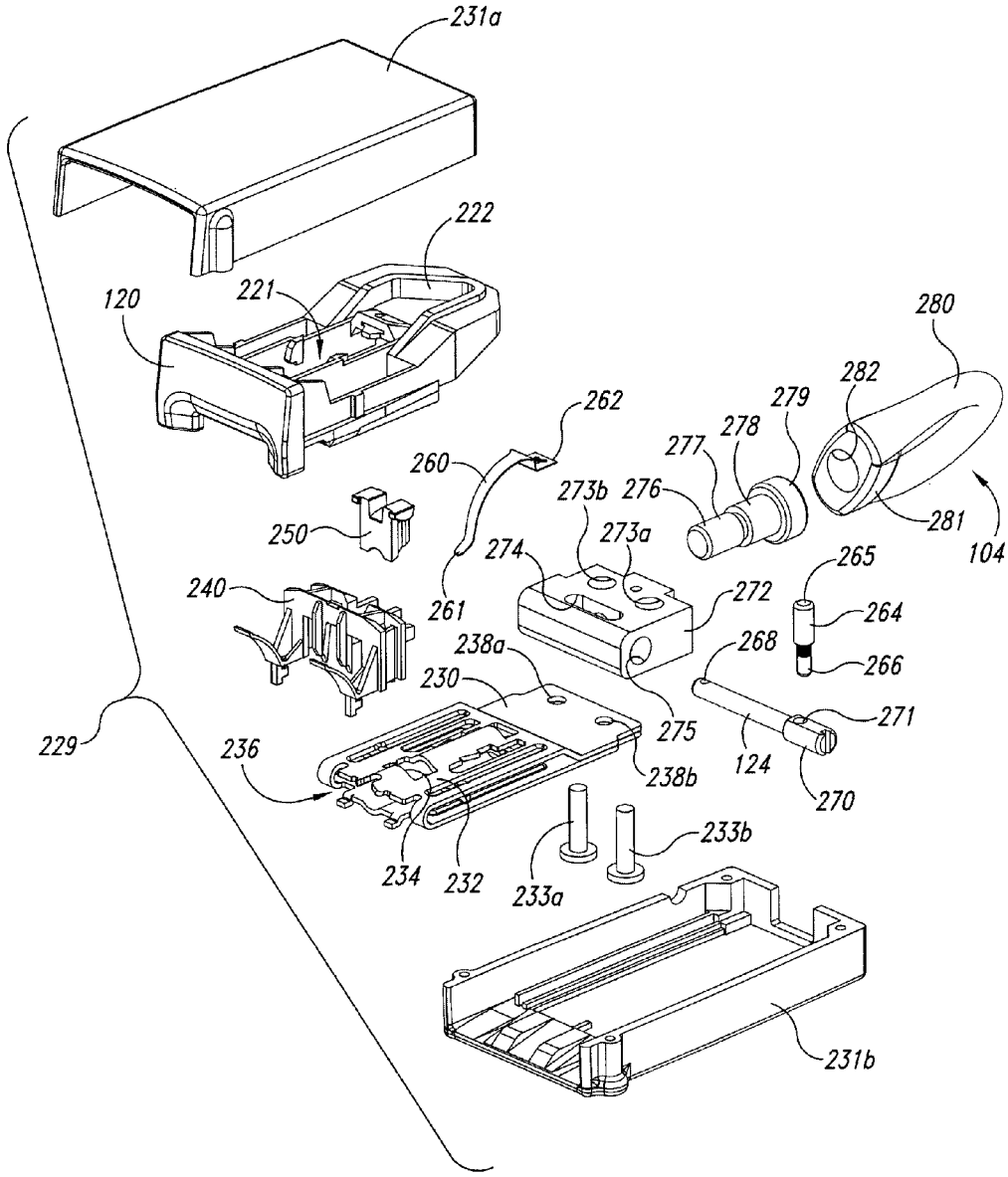
FIG. 2C is an exploded isometric view.
Figure 2D:
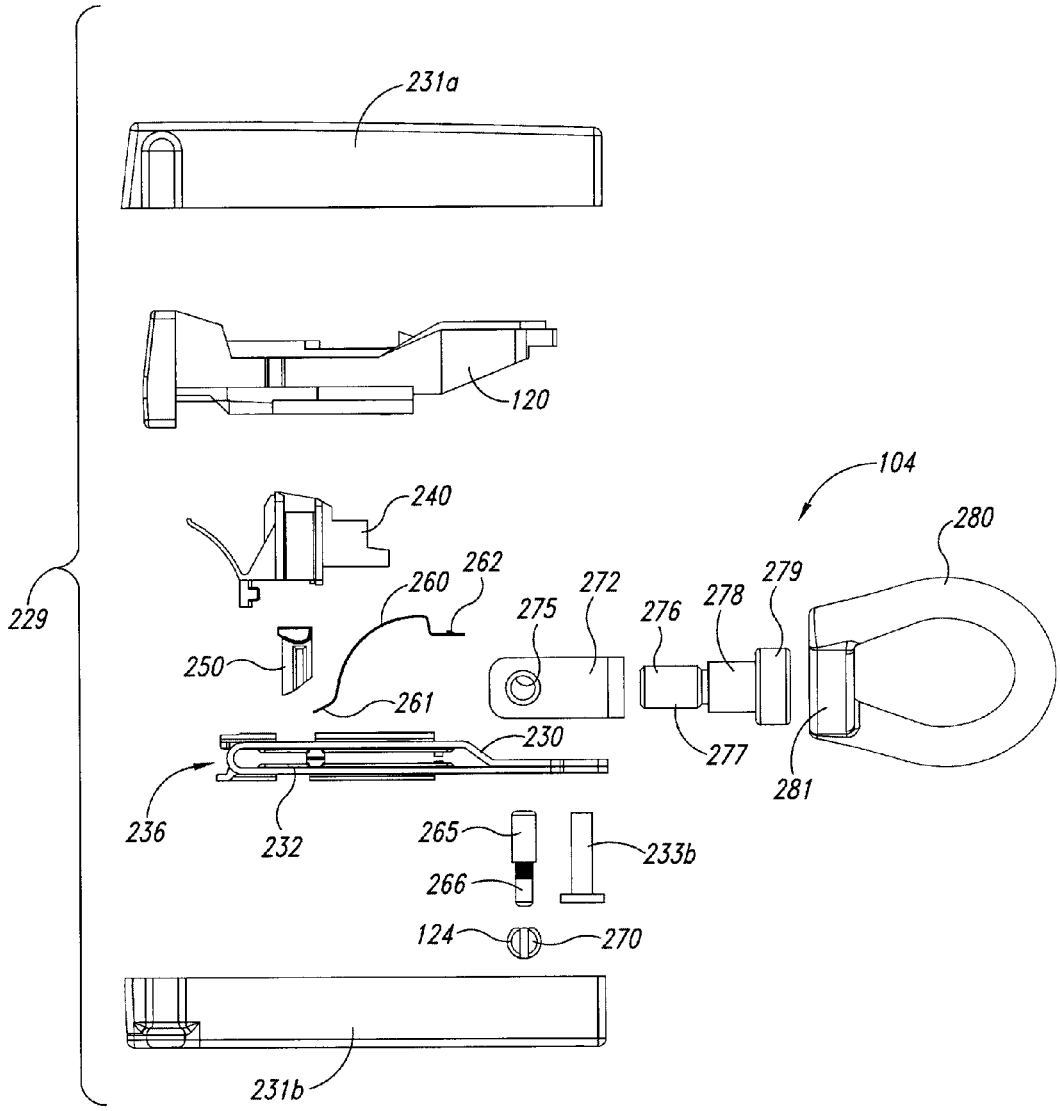
FIG. 2D is an exploded side view of the of the buckle assembly of FIG. 1.

FIG. 2A is a partially exploded isometric view, FIG. 2B is a partially exploded side view, FIG. 2C is an exploded isometric view, and FIG. 2D is an exploded side view of the of the buckle assembly 100 of FIG. 1. Referring to FIGS. 2A-2D together, in one aspect of this embodiment the buckle assembly 100 includes a housing or cover 229 that generally encloses the internal components of the buckle assembly 100. The cover 229 can include a first or top cover 231*a* opposite a second or bottom cover 231*b*. The first cover 231*a* and the second cover 231*b* can include several locating features or openings for securely locating and/or coupling to one another as well as the corresponding features of the buckle assembly 100.

According to another aspect of the illustrated embodiment, the buckle assembly 100 also includes a support structure or frame 230 positioned inside the cover 229 and coupled to several of the other corresponding components of the buckle assembly 100. In the illustrated embodiment, the frame 230 includes a tongue opening 236 (FIGS. 2C and 2D) configured to removably receive the web connector tongue 112 (FIG. 1). The frame 230 also includes a base portion 232 (FIGS. 2C and 2D) that is slidably coupled to the first release actuator or button 120. The base portion 232 is also configured to secure or engage an alignment guide 240 on the frame 230. The base portion 232 further includes a locking member channel or opening 234 (FIG. 2C) that movably receives a pawl or locking feature or member 250 (FIGS. 2B-2C). The locking member 250 is configured to slidably move at least partially within the alignment guide 240 and the locking member opening 234 in the frame 230.

According to another aspect of the embodiment illustrated in FIGS. 2A-2D, the buckle assembly 100 includes a spring or biasing member 260 configured to bias or urge the locking member 250 toward a locked position (FIG. 2B) relative to the frame 230. More specifically, the biasing member 260 includes a first end portion 261 that is coupled to the locking member 250, and a second end portion 262 opposite the first end portion 261. The second end portion 262 is coupled to the release button 120. The biasing member 260 is curved or otherwise configured to bias or push the locking member 250 toward the locked position. In certain embodiments, the biasing member 260 can be made from a metallic material, such as spring steel. In other embodiments, however, the biasing member 260 can be made from other suitable biasing materials. As explained in detail below, when the release button 120 is actuated (via a first release mechanism or a second release mechanism), the release button 120 moves the locking member 250 against the biasing member 260 and out of the locked position to disengage the web connector tongue 112 (FIG. 1).

In another aspect of the illustrated embodiment, the release button 120 includes an opening 221 (FIG. 2C) extending therethrough and at least partially defining an interior surface of the release button 120. The release button 120 at least partially receives the alignment guide 240, the locking member 250, and the biasing member 260 in the opening 221. The release button 120 also includes a slanted or angled release pin contact surface 222 (FIGS. 2A and 2C) at least partially defined by the opening 221. The release pin contact surface 222 is configured to contact a corresponding release pin 264 to actuate or move the release button 120. With reference to FIGS. 2C and 2D, the release pin 264 includes a first end portion 265 that slides along the release pin contact surface 222. The release pin 264 also includes a second end portion 266 opposite the first end portion 265 that is coupled to the second release actuator 124. More specifically, the second release actuator 124 includes a first end portion 270 with a release pin opening 271 that receives the second end portion 266 of the release pin 264. The second release actuator 124 also includes a second end portion 268 opposite the first end portion 270 that is accessible outside of the cover 229. Accordingly, the second end portion 268 is easily accessible for a user to pull and actuate the release button 120 to move the release pin 264 along the release pin contact surface 222 of the release button 120.

According to yet another aspect of the illustrated embodiment, the buckle assembly 100 further includes a support block 272 that is secured to the frame 230 with multiple fasteners 233 (e.g., bolts, screws, rivets, pins, posts, etc., and identified individually as a first fastener 233*a* and a second fastener 233*b*). More specifically, the fasteners 233 extend through corresponding frame fastener openings 238 (identified individually as a first frame fastener opening 238*a* and a second frame fastener opening 238*b*) and corresponding support block fastener openings 273 (identified individually as a first support block fastener opening 273*a* and a second support block fastener opening 273*b*). The support block 272 also includes a release actuator opening 275 (FIGS. 2C and 2D) that slidably receives the second release actuator 124, as well as a release pin slot 274 (FIG. 2C) that slidably receives the release pin 264. The release pin slot 274 has a generally oblong or oval shape and extends partially into the support block 272 to intersect the release actuator opening 275. Accordingly, the first end portion 265 of the release pin 264 can slidably move through the release pin slot 274 as the second release actuator 124 slidably moves through the release actuator opening 275 in the support block 272.

In another aspect of the illustrated embodiment, the swivel subassembly 104 is coupled to the support block 272. More specifically, the swivel subassembly 104 includes a swivel fastener 277 (e.g., a bolt, shoulder bolt, screw, etc.) that coupled a swivel web connector 280 (e.g., a looped connector or eye nut). The swivel fastener 277 includes a first end portion 276 opposite a second end portion 278 carrying a flange or head portion 279. The first end portion 276 of the swivel fastener 277 is secured in the support block 272, and the second end portion 278 is received in a swivel fastener opening 282 (FIG. 2C) of the swivel web connector 280. A base portion 281 of the swivel web connector 280 is therefore rotatably secured between the support block 272 and the head portion 279 of the swivel fastener 277. As such, the swivel web connector 280 can freely rotate with reference to the frame 230.

Further details regarding the components of the buckle assembly are described in detail below with reference to FIGS. 3A-7D.

Figure 3B:
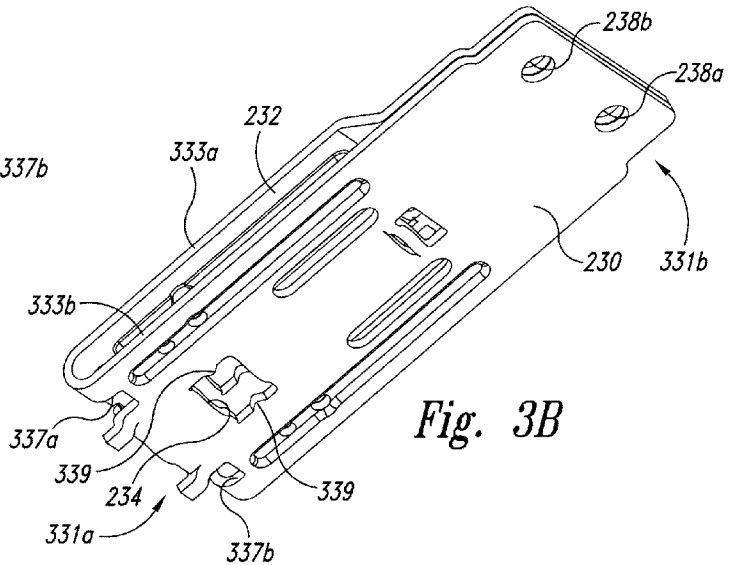
FIGS. 3A and 3B are isometric views.
Figure 3D:
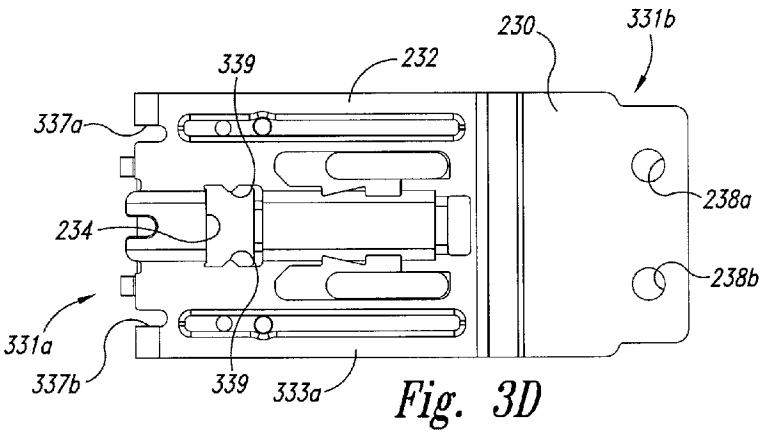
FIG. 3D is a top view of a frame of the buckle assembly of FIGS. 2A-2D.
Figure 3A:
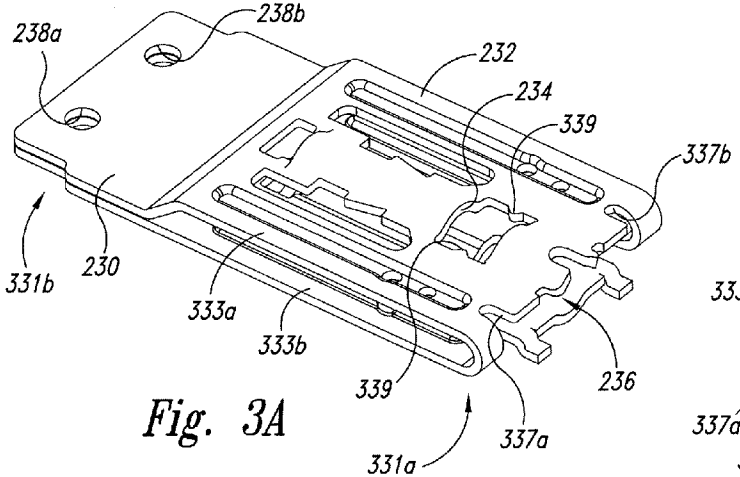
Figure 3C:
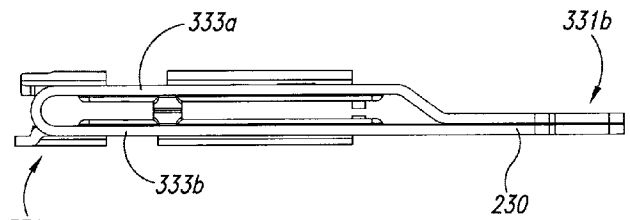
FIG. 3C is a side view.

FIGS. 3A and 3B are isometric views, FIG. 3C is a side view, and FIG. 3D is a top view of the support member or frame 230 the buckle assembly 100 of FIGS. 2A-2D. Referring to FIGS. 3A-3D together, in the illustrated embodiment the frame 230 includes a unitary base portion 232 having a first base-half 333*a* spaced apart from a second base-half 333*b*. In other embodiments, however, the first and second base-halves 333*a*, 333*b* can be separate components that are attached to each other. The frame 230 can be manufactured from a suitable metallic material, such as steel plate that is stamped and formed to shape with the first base-half 333*a* opposite the second base-half 333*b*. In other embodiments, other metals (e.g., other steels, aluminum, etc.) that are stamped, pressed, cast, forged, machined, and/or otherwise formed to shape using suitable methods known in the art can be used. In further embodiments, the frame 230 can be manufactured from composites and/or other suitable nonmetallic materials having suitable strength, stiffness, and/or other characteristics.

In the illustrated embodiment, the first base-half 333*a* is configured to contact the release button 120, the biasing member 260, and the support block 272 (see, e.g., FIGS. 2A-2D). The second base-half 333*b* is configured to contact an interior surface of the bottom cover 231*b*. The base portion 232 further includes a first end portion 331*a* opposite a second end portion 331*b*. The first end portion 331*a* includes the tongue opening 236 (FIG. 3A), which is formed in the frame 230 between the first base-half 333*a* and the second base-half 333*b*. The frame 230 also includes the locking member opening 234 extending through the first base-half 333*a* and the second base-half 333*b*. Each of the first and second halves 333*a*, 333*b* of the frame 230 includes alignment projections 339 partially extending into the locking member opening 234. The alignment projections 339 are configured to contact or engage corresponding alignment grooves in the locking member 250 (see, e.g., FIGS. 5A-5C).

According to another aspect of the illustrated embodiment, at the first end portion 331*a* the first base-half 333*a* is spaced apart form the second base-half 333*b* to allow the tongue portion 112 of the web connector 108 (FIG. 1) to fit therein. As also shown in the illustrated embodiment, the first end portion 331*a* includes multiple engaging recesses 337 (identified individually as a first engaging recess 337*a* and a second engaging recess 337*b*) partially extending through each of the first base-half 333*a* and the second base-half 333*b*. The engaging recesses 337 are configured to contact or engage corresponding projections from the alignment guide 240. As also shown in the illustrated embodiment, at the second end portion 331*b* of the frame 230, the first base-half 333*a* is posited adjacent to and contacts the second base-half 333*b*. The second end portion 331*b* also includes the frame fastener openings 238 that are configured to receive the corresponding support block fasteners 233 for attachment to the support block 272 (FIG. 2C).

Figure 4B:
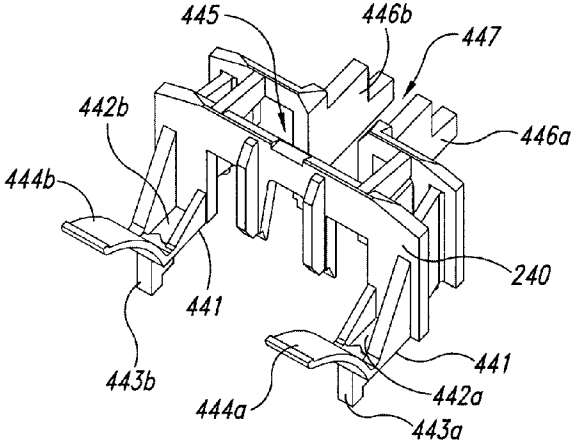
FIGS. 4A and 4B are isometric views.
Figure 4D:
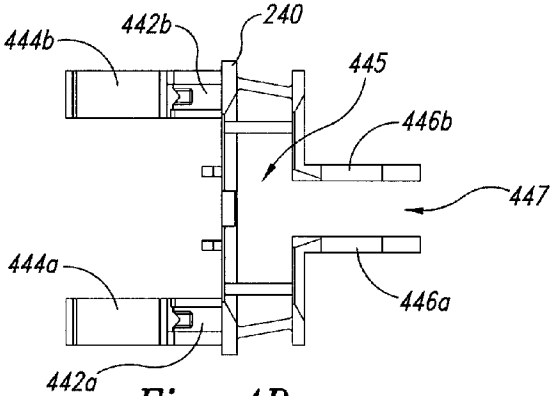
FIG. 4D is a top view of an alignment guide of the buckle assembly of FIGS. 2A-2D.
Figure 4A:
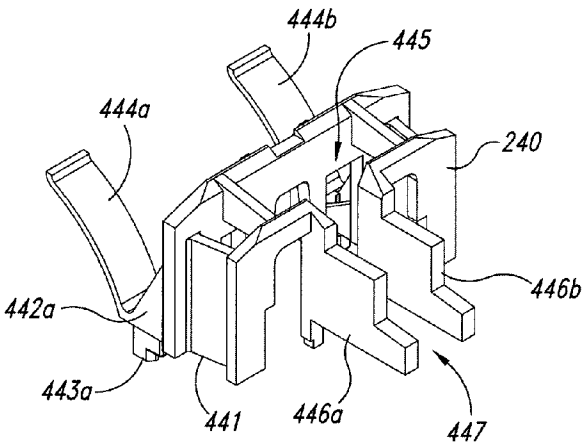
Figure 4C:
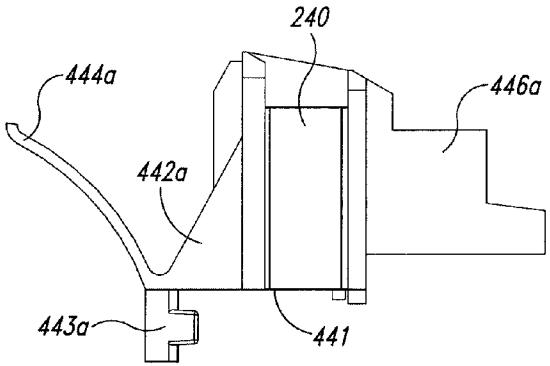
FIG. 4C is a side view.

FIGS. 4A and 4B are isometric views, FIG. 4C is a side view, and FIG. 4D is a top view of the alignment guide 240 of the buckle assembly 100 of FIGS. 2A-2D. Referring to FIGS. 4A-4D together, the alignment guide 240 includes a first arm 442*a* spaced apart from a second arm 442*b*. Each arm 442 includes a corresponding biasing extension 444 (identified individually as a first biasing extension 444*a* and a second biasing extension 444*b*) extending therefrom. Each arm 442 also includes an alignment extension 443 (identified individually as a first alignment extension 443*a* and a second alignment extension 443*b*) projecting from a lower surface 441 of the alignment guide 240. The lower surface 443 is configured to rest against the first base-half 333 of the frame 230 in the buckle assembly 100 (see, e.g., FIGS. 2A-2D). The alignment extensions 443 are configured to contact or engage the corresponding engaging recesses 337 of the first end portion 331*a* of the frame 230 to retain the alignment guide 240 generally stationary with reference to the frame 230. The biasing extensions 444 are configured to contact an interior surface of the release button 120 to provide a biasing or resistive force against the release button 120 as the release button 120 moves along the frame 230 between the locked and unlocked positions.

According to another feature of the embodiment shown in FIGS. 4A-4D, the alignment guide 240 includes a locking member guide channel 445 and a biasing member channel 447 formed between two locking member stepped guide arms 446 (identified individually as a first stepped guide arm 446*a* and a second stepped guide arm 446*b*). The locking member guide channel 445 is sized and shaped to receive the locking member 250 (FIGS. 2A-2D) and allow the locking member 250 to move within the alignment guide 240 between the locked and unlocked positions. The biasing member channel 447 is configured to allow for the movement of the biasing member 260 through the alignment guide 240 as the locking member 250 moves between the locked and unlocked positions.

Figure 5A:
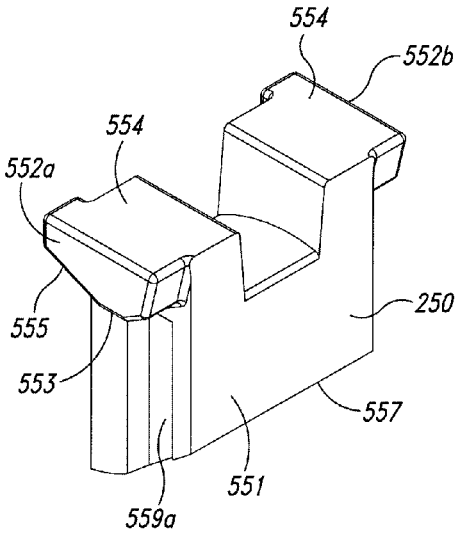
FIGS. 5A-5C are isometric views and FIG. 5D is a side view of a movable locking member or pawl of the buckle assembly of FIGS. 2A-2D.
Figure 5B:
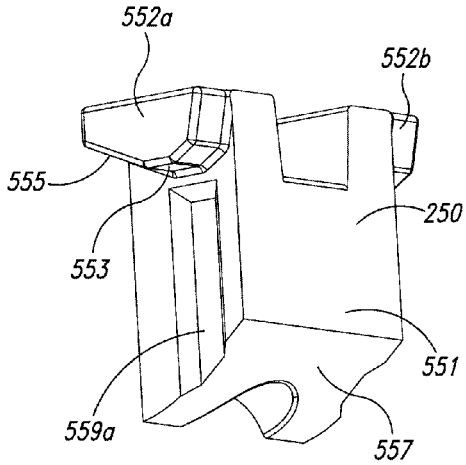
Figure 5C:
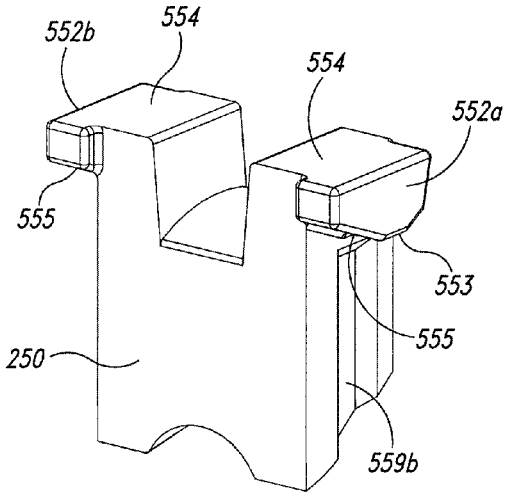
Figure 5D:
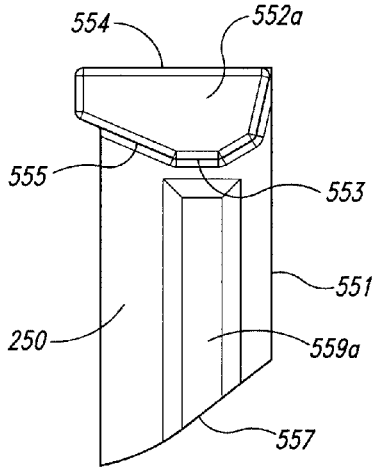

FIGS. 5A-5C are isometric views and FIG. 5D is a side view of a movable pawl or locking member 250 of the buckle assembly 100 of FIGS. 2A-2D. Referring to FIGS. 5A-5D together, the locking member 250 is configured to be positioned within the pawl aperture 114 of the tongue 112 to lock the web connector 108 in the buckle assembly 100 (FIG. 1). For example, the locking member 250 includes a first locking surface 551 that is configured to contact or engage an interior surface of the tongue 112 in the pawl aperture 114. The locking member 250 also includes a first ramped surface 557 that is configured to contact the tongue 112 only after the locking member 250 has been at least partially moved out of the locked position. As such, the tongue 112 can contact the ramped surface 557 to urge or at least partially help to move the locking member 250 toward the unlocked position. The locking member 250 also includes alignment grooves or channels 559 (identified individually as a first alignment channel 559*a* and a second alignment channel 559*b*) that are configured to at least partially receiving the corresponding alignment projections 339 in the alignment opening 234 of the frame 230 (FIGS. 3A-3D). The alignment channels 559 are configured to guide or align the locking member 250 with reference to the frame 230 as the locking member 250 moves between the locked and unlocked positions.

According to another aspect of the illustrated embodiment, the locking member 250 also includes locking extensions or arms 552 (identified individually as a first locking arm 552*a* opposite a second locking arm 552*b*). Each locking arm 552 includes multiple surfaces that are configured to engage or contact the release button 120 (FIGS. 2A-2D) to retain the locking member 250 in a locked position and to move the locking member 250 into the unlocked position. More specifically, each locking arm 552 includes a first or resting surface 553 opposite a second or lock surface 554. Each locking arm 552 also includes a third or sliding surface 555 extending at an inclined angle from the first or resting surface 553. The resting surfaces 553, the lock surfaces 554, and the sliding surfaces 555 are each configured to contact or otherwise interact with the release button 120 as the release button 120 moves the locking member 250 between the locked and unlocked positions. The contact or engagement of these surfaces with the release button 120 are described in detail below with reference to FIGS. 7A and 7B.

Figure 6A:
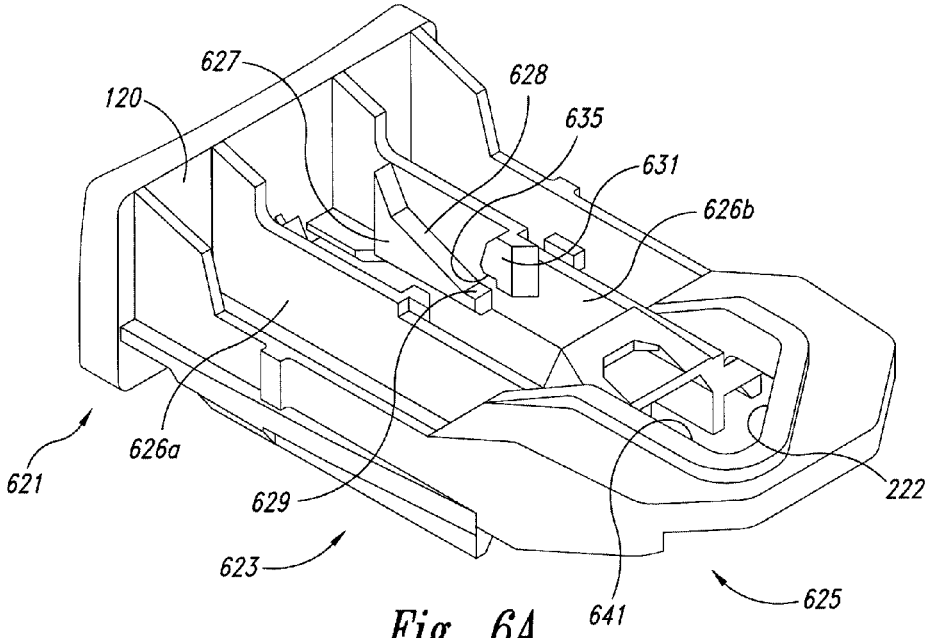
FIGS. 6A and 6B are isometric views
Figure 6B:
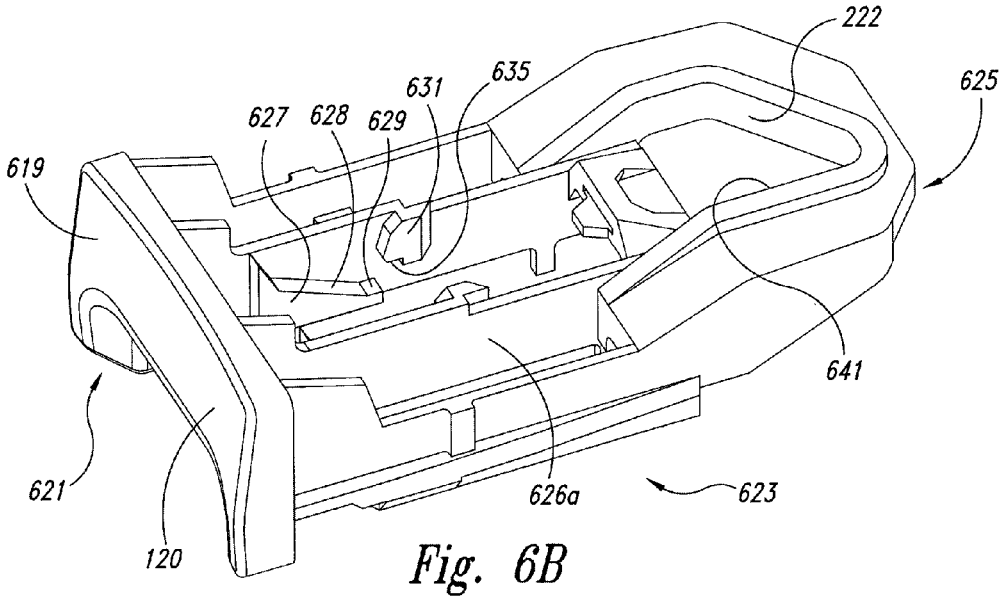
Figure 6C:
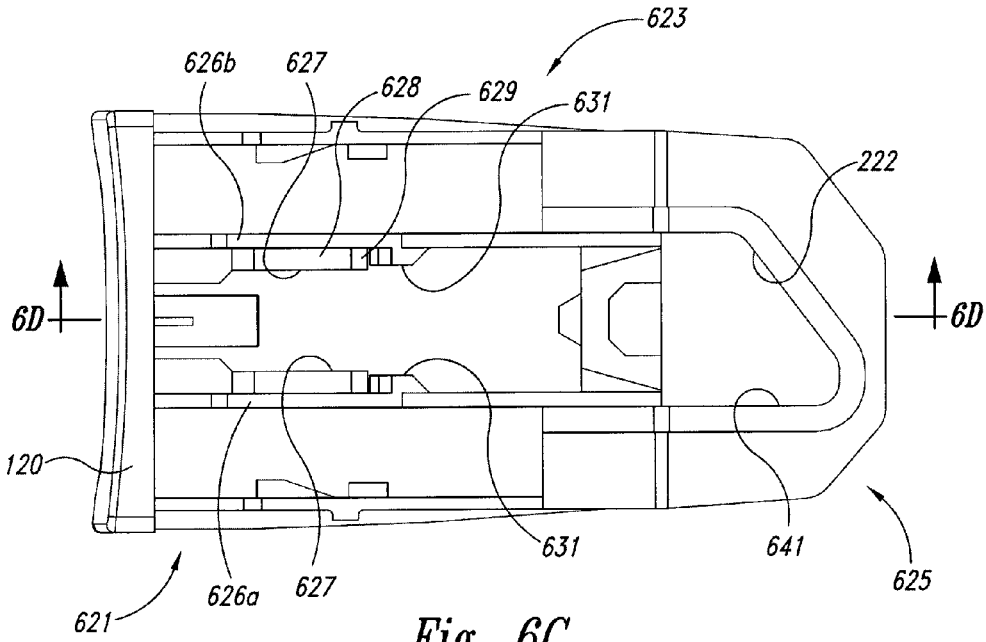
FIG. 6C is a top view.
Figure 6D:
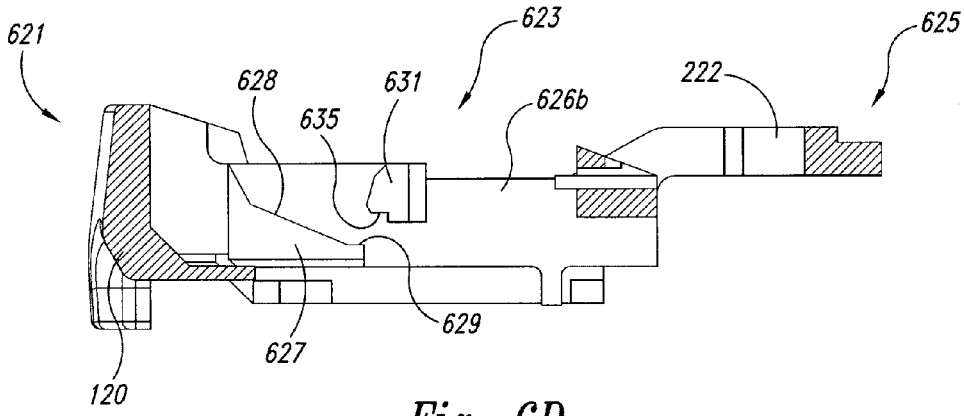
FIG. 6D is a side cross-sectional view taken substantially along line 6D-6D of FIG. 6C of a first actuator or release button of the buckle assembly of FIGS. 2A-2D.

FIGS. 6A and 6B are isometric views, FIG. 6C is a top view, and FIG. 6D is a side cross-sectional view taken substantially along line 6D-6D of FIG. 6C of the first actuator or release button 120 of the buckle assembly 100 of FIGS. 2A-2D. Referring to FIGS. 6A-6D together, the release button 120 includes a middle portion 623 between a first end portion 621 and a second end portion 625. The first end portion 621 can include an exterior surface 619 that is configured to be externally accessible for a user to push or depress to move or actuate the release button 120.

According to another aspect of the illustrated embodiment, the middle portion 623 includes several features that are configured to engage or otherwise contact the locking member 250 to move the locking member 250 between the locked and unlocked positions. For example, in the middle portion 623 the release button 120 includes sidewalls 626 (identified individually as a first sidewall 626*a* spaced apart from a second sidewall 626*b*) extending longitudinally along the release button 120. Each sidewall 626 includes a release feature or release protrusion 627 spaced apart from a locking feature or locking protrusion 631. In certain embodiments, the release protrusion 627 and the locking protrusion 631 are integrally formed in the corresponding sidewall 626. In other embodiments, however, the release protrusion 627 and the locking protrusion 631 can be separate components that are attached to the corresponding sidewall 626. Each release protrusion 627 includes a first or unlocking surface 628 extending from a second or resting surface 629. The unlocking surface can be a ramped surface extending (e.g., extending upwardly) from the resting surface 629 at an inclined angle. Each locking protrusion 631 includes a third or locking surface 635 that is spaced apart from and generally parallel to the resting surface 629. The contact or engagement of these surfaces of the release button 120 with the locking member 250 is described in detail below with reference to FIGS. 7A and 7B.

According to yet another aspect of the embodiment illustrated in FIGS. 6A-6D, the second end portion 625 includes an opening 641 extending therethrough. The opening 641 at least partially defines the release pin contact surface 222 of the second end portion 625. The release pin contact surface 222 extends at an inclined angle relative to a longitudinal axis of the release button 120. Further details regarding the interaction of the release pin contact surface 222 and the release pin 264 are described in detail below with reference to FIGS. 7C and 7D.

Figure 7A:
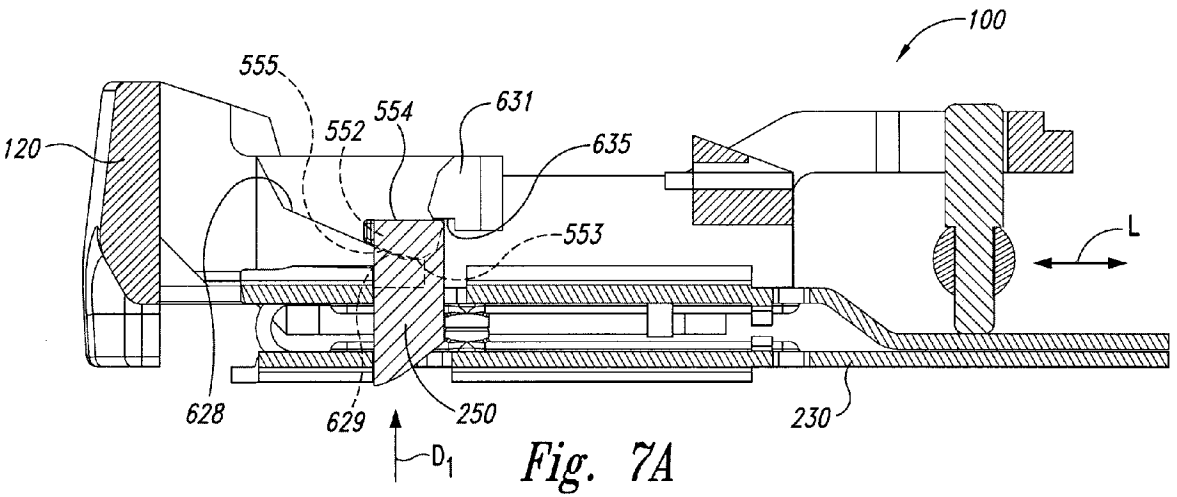
FIGS. 7A and 7B are cross-sectional partial side views taken substantially along line 7-7 of FIG. 2A, and FIGS. 7C and 7D are top partial views illustrating various operational aspects of the buckle assembly 100 and corresponding components of the buckle assembly illustrated in FIGS. 1-6D.
Figure 7B:
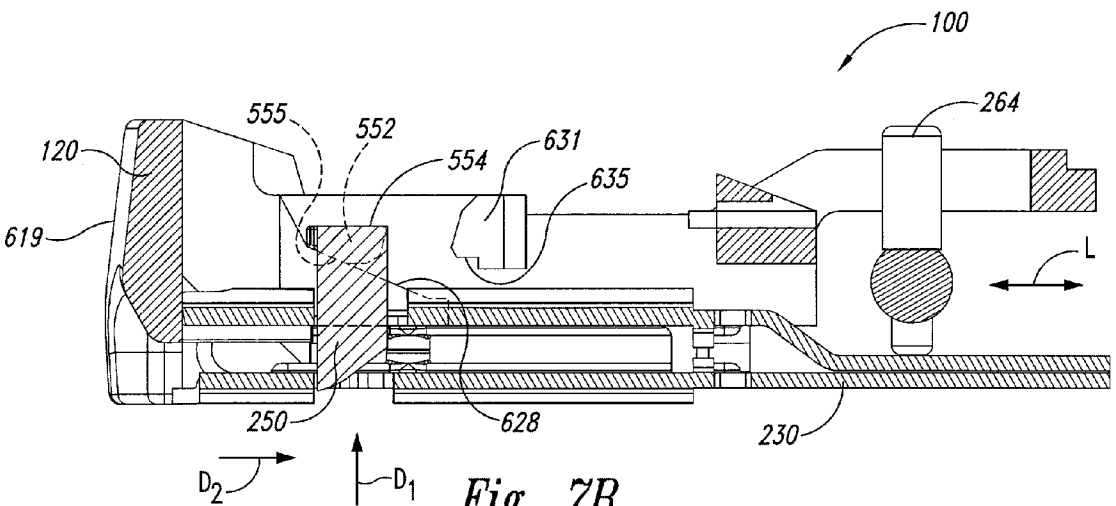
Figure 7C:
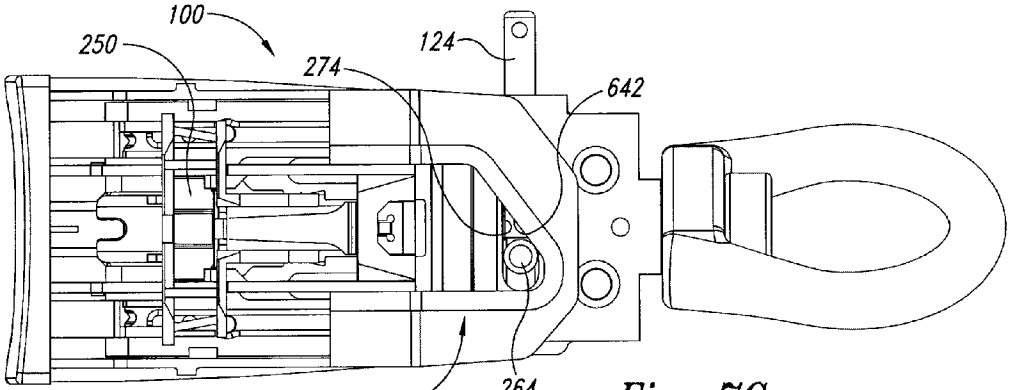
Figure 7D:
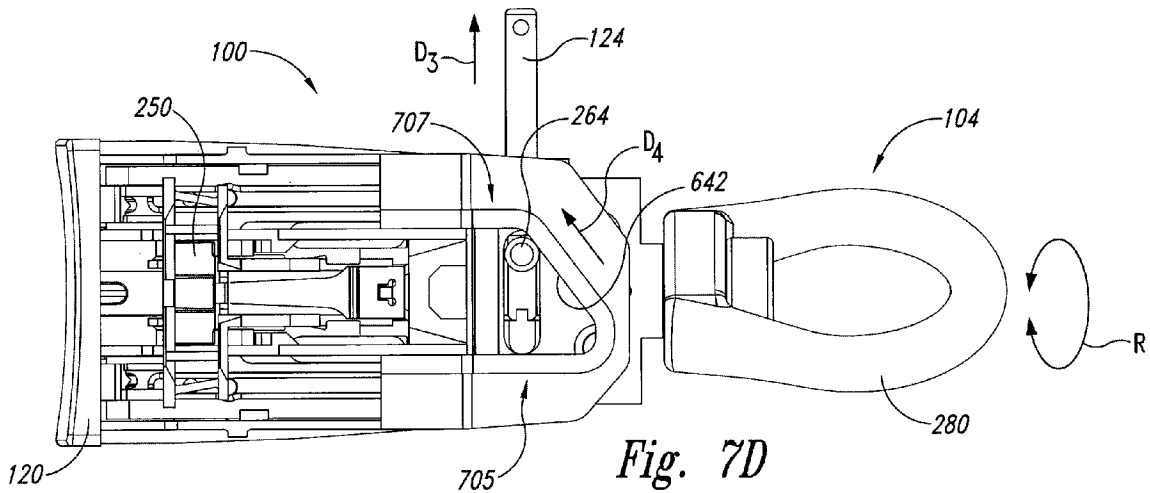

FIGS. 7A and 7B are cross-sectional partial side views taken substantially along line 7-7 of FIG. 2A, and FIGS. 7C and 7D are top partial views illustrating various operational aspects of the buckle assembly 100 and corresponding components illustrated in FIGS. 1-6D. In FIGS. 7A-7D, the cover 229 and swivel sub-assembly 104 are removed from the buckle assembly 100 to illustrate several of the internal features of the buckle assembly 100. Moreover, in FIGS. 7A and 7B, the alignment guide 240 is also removed to illustrate several of the features of the release button 120 and the locking member 250. Referring first to FIG. 7A, for example, the buckle assembly 100 is illustrated in a locked position. With the locking member 250 in the locked position with reference to the frame 230 and the release button 120, the locking member 250 is positioned to engage or retain a tongue from a web connector locked in the buckle assembly 100. More specifically, in the locked position the resting surface 553 and the sliding surface 555 of the locking arm 552 of the locking member 250 contact or rest against the resting surface 629 and the unlocking ramped surface 628, respectively, of the release button 120. At this point, the top locking surface 554 of the locking arm 552 is positioned adjacent to (e.g., below) the corresponding locking surface 635 of the locking protrusion 631. Accordingly, in the locked position, the locking protrusion 631 of the release button 120 at least partially prevents the locking member 250 from moving in an unlocking direction $D_1$ relative to the frame 230 (e.g., in a direction generally perpendicular to a longitudinal axis L of the buckle assembly 100).

Referring next to FIG. 7B, when an operator moves the release button 120 in a second direction $D_2$ relative to the frame 230 (e.g., in a direction generally parallel to the longitudinal axis L of the buckle assembly 100), the release button 120 moves the locking member 250 to an unlocked position (e.g., to a position in which the locking member 250 allows a corresponding tongue of a web connector to be withdrawn from the buckle assembly 100). In one embodiment, the user can actuate the release button 120 by pressing the exterior surface 619 to move the release button 120 in the second direction $D_2$. As explained in detail below, however, the user can also actuate the release button via the release pin 264. As shown in FIG. 7B, as the release button 120 moves in the second direction $D_2$, the ramped unlocking surface 628 of the release button 120 contacts the sliding surface 555 of the locking arm 552. Accordingly, the release button 120 slides or drives the locking member 250 along the unlocking surface 628 to move the locking member 250 in the unlocking direction $D_1$ relative to the frame 230 (i.e., in a direction generally perpendicular to a longitudinal axis of the buckle assembly 100). At this point, the locking surface 554 of the locking arm 552 is spaced apart from and has cleared the locking surface 635 of the locking protrusion 631.

Referring next to FIG. 7C, the buckle assembly 100 is illustrated again in the locked position. As shown in the illustrated embodiment, the release pin 264 extends from the second actuator 124 through the release pin slot 274. In the locked position, the release pin 264 contacts the release pin contact surface 222 of the release button 120 at a first lateral side portion 705 of the release button 120. Referring next to FIG. 7D, which illustrates the buckle assembly 100 in the unlocked position, when a user has pulled the second release actuator 124 in a third direction $D_3$ (i.e., in a direction generally perpendicular to a longitudinal axis of the buckle assembly 100), the release pin 264 slides along the release pin contact surface 222 along a fourth direction $D_4$ at an inclined angle relative to a longitudinal axis of the buckle assembly 100. As the release pin 264 moves perpendicularly to the longitudinal axis of the buckle assembly 100 and along the fourth direction $D_4$ on the release pin contact surface 222, the release pin 264 drives or urges the release button 120 to the unlocked position, and the release button 120 in turn moves the locking member 250 to the unlocked position.

According to yet another feature of the embodiment illustrated in FIG. 7D, the swivel subassembly 104 allows the swivel web connector 280 to rotate in directions R (e.g., rotation about a longitudinal axis of the buckle assembly 100). Accordingly, the swivel subassembly 104 prevents a web 102 (FIG. 1) that is attached to the swivel web connector 280 from twisting or becoming misaligned during use.

Figure 8:
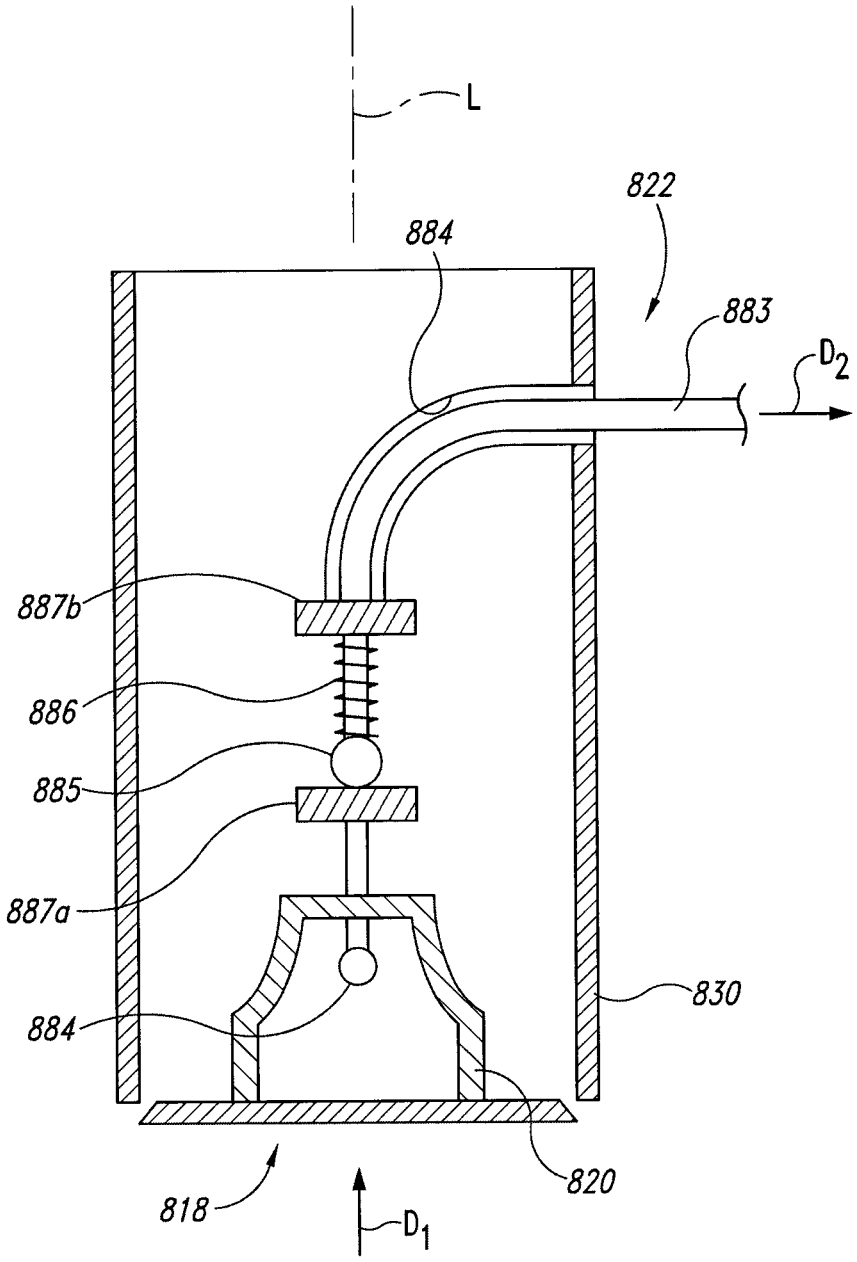
FIG. 8 is a cross-sectional view of a buckle assembly configured in accordance with another embodiment of the disclosure.

FIG. 8 is a cross-sectional view of a buckle assembly 800 configured in accordance with another embodiment of the disclosure. The buckle assembly 800 includes several features that are generally similar in structure and function to the corresponding features of the buckle assembly 100 described above with reference to FIGS. 1-7D. For example, the illustrated buckle assembly 800 can include a swivel subassembly (not shown) as well as a first release subassembly 818 and a second release subassembly 822. More specifically, the first release subassembly 818 includes a first release actuator or button 820 that moves within a cover, housing, or frame 830 of the buckle assembly 800. The release button 820 moves in a first Direction $D_1$ that is generally parallel to a longitudinal axis L of the buckle assembly 100 to move to an unlocked position.

According to another aspect of the illustrated embodiment, however, the second release subassembly 822 includes a flexible release connector 883, such as a flexible cable, wire, or other suitable type of flexible connector that moves through a connector guide or channel 884 in the housing 830. The release connector 883 can be attached to a handle or similar gripping device to allow a user to easily grip and pull the release connector 883. In the illustrated embodiment, the release connector 883 includes a connector stop 884 at a distal end portion thereof that is configured to contact and pull the release button 820 when a user pulls the release connector 883. More specifically, when a user pulls the release connector 883 in a second direction $D_2$, which is generally perpendicular to the first direction $D_1$ and the longitudinal axis L of the buckle assembly 800, the connector stop 884 pulls the release button 820 to the unlocked position. In other embodiments, however, the release connector 883 can extend or be pulled at angles other than perpendicular to the longitudinal axis L of the buckle assembly 800.

In certain embodiments, the buckle assembly 800 can also include a second release connector stop 885 and a biasing member 886 (e.g., a coil spring) positioned between a first wall 887*a* and a corresponding second wall 887*b*. In an unlocked position, the biasing member 886 can push against the second wall 887*b* to urge the second connector release stop 885 toward the first wall 887*a* so that the first release connector stop 884 is spaced apart from or otherwise disengaged from the release button 820. To move the release button 820 to the unlocked position, a user can pull or otherwise actuate the release connector 883, which in turn compresses the biasing member 886 via the second release connector stop 885 until the first release connector stop 884 contacts and moves the release button 820 in the first direction $D_1$.

Figure 9A:
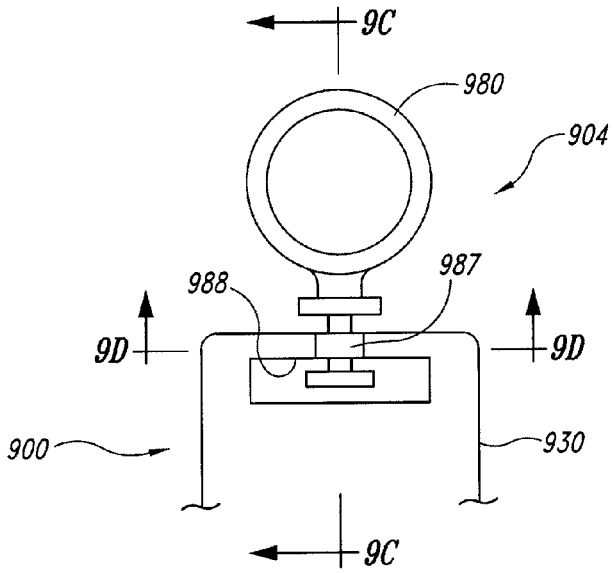
FIG. 9A is a top view of a portion of a buckle assembly configured in accordance with yet another embodiment of the disclosure.
Figure 9B:
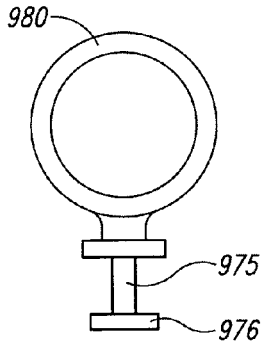
FIG. 9B is a top view of a swivel connector of the buckle assembly of FIG. 9A.
Figure 9C:
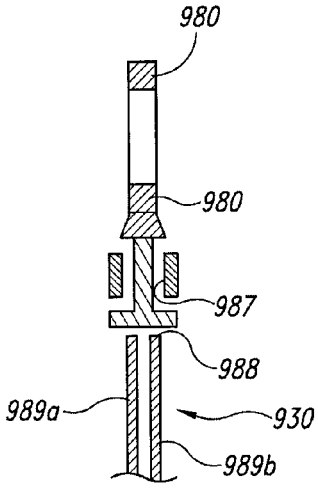
FIG. 9C is a cross-sectional side view taken substantially along line 9C-9C of FIG. 9A.
Figure 9D:
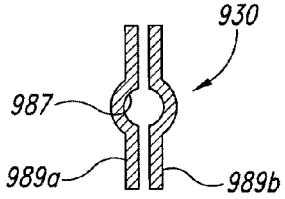
FIG. 9D is a cross-sectional side view of the buckle assembly of FIG. 9A taken substantially along line 9D-9D of FIG. 9A.

FIG. 9A is a partial top view of a buckle assembly 900 configured in accordance with yet another embodiment of the disclosure. FIG. 9B is a top view of a swivel connector 980 of the buckle assembly of FIG. 9A. FIG. 9C is a cross-sectional side view taken substantially along line 9C-9C of FIG. 9A, and FIG. 9D is a cross-sectional side view taken substantially along line 9D-9D of FIG. 9A. Referring to FIGS. 9A-9D together, the buckle assembly 900 includes a frame 930 coupled to a swivel subassembly 904 having several features that are generally similar in structure and function to the corresponding features of the of the swivel subassembly 104 described above with reference to FIGS. 1-8. For example, the swivel subassembly 904 illustrated in FIGS. 9A-9D includes a swivel web connector 980 (e.g., a looped connector or eye nut) configured to be coupled to a web. The swivel subassembly 904 also includes a swivel fastener 975 coupled to and extending from the swivel connector 980 into the frame 930. The swivel fastener 975 extends through an enlarged opening 987 in the frame 930. The swivel fastener 975 includes an end portion 976 that extends from the swivel web connector 980 and is positioned in a slot 988 in the frame 930. As shown in FIGS. 9C and 9D, the frame 930 can also include a first frame portion 989*a* opposite and securely fastened to a second frame portion 989*b*. In certain embodiments, the first frame portion 989*a* can be integral with the second frame portion 989*b*. In other embodiments, however, the first frame portion 989*a* can separate from and attached to the second frame portion 989*b*.

Figure 10B:
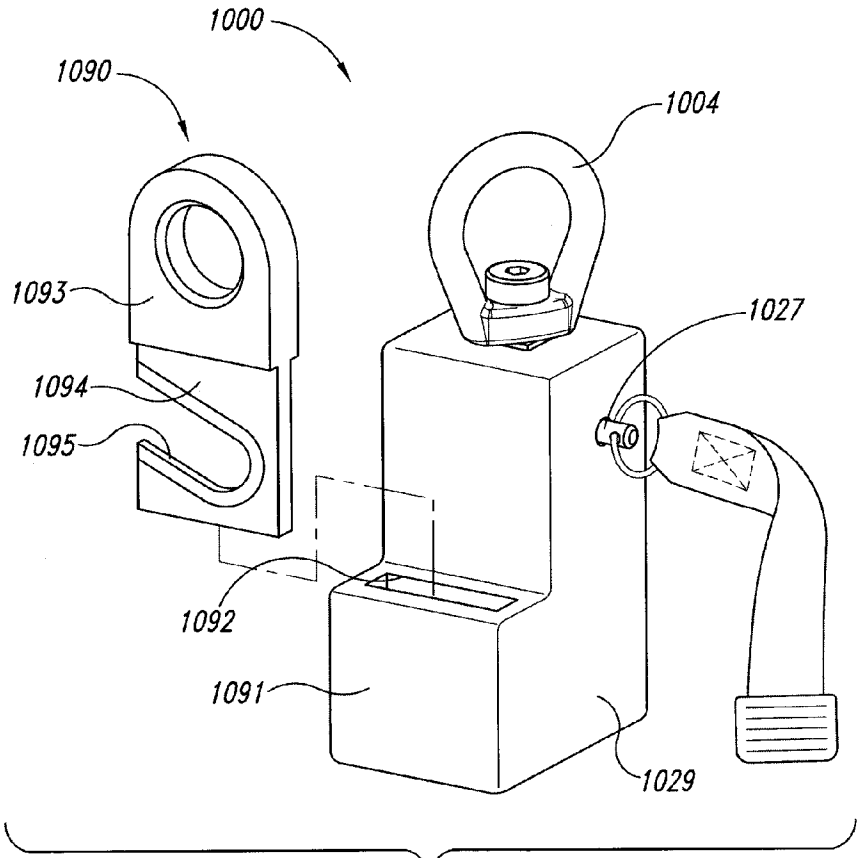
FIG. 10A is an isometric view and FIG. 10B is a partially exploded isometric view of a buckle assembly configured in accordance with yet another embodiment of the disclosure.
Figure 10A:
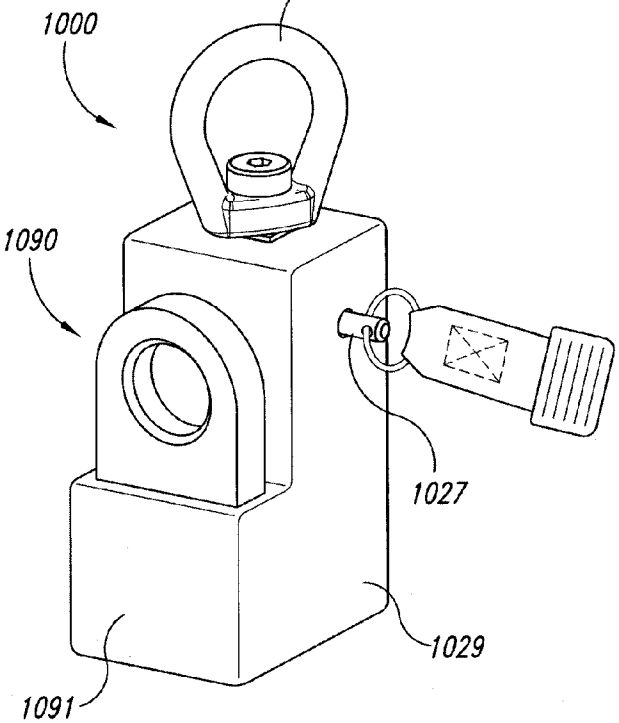

FIG. 10A is an isometric view and FIG. 10B is a partially exploded isometric view of a buckle assembly 1000 configured in accordance with yet another embodiment of the disclosure. The buckle assembly 1000 illustrated in FIGS. 10A and 10B includes several features that are generally similar in structure and function to the corresponding features of the buckle assemblies described above with reference to FIG. 1-9D. For example, in the embodiment illustrated in FIGS. 10A and 10B, the buckle assembly 1000 can include a dual release mechanism (e.g., a first release subassembly and a second release subassembly 1027) to disengage a web connector (not shown). The illustrated buckle assembly 1000 also includes a swivel subassembly 1004 extending away from a housing 1029. The housing can include one or more covers that are joined together similar to the covers described above.

In the illustrated embodiment, however, the buckle assembly 1000 also includes a web cutter 1090 that is removably carried by the housing 1029. More specifically, the housing 1029 includes a web cutter carrying portion 1091 including an opening 1092 therein that is configured to removably receive the web cutter 1090. The web cutter 1090 includes a blade 1094 projecting from a gripping portion or handle 1093 (FIG. 10B). The blade 1094 includes a sharpened cutting portion or edge 1095 that is configured to allow a user to easily cut through a web (not shown) coupled to the buckle assembly 1000. For example, in the illustrated embodiment, the cutting portion 1095 has a curved or generally U-shaped configuration that allows a user to hook the web to pull and cut through the web. Accordingly, the embodiment illustrated in FIGS. 10 and 10B allows a user to cut the buckle assembly 1000 from a corresponding web in an emergency or other situation when a user is unable to otherwise disengage the web from the buckle assembly 1000.

The embodiments of the buckle assemblies including dual release features provide several advantages over conventional buckle assemblies. One advantage, for example, is that a buckle assembly of the present disclosure eliminates the need for the buckle assembly to be oriented so that the first actuator or release button is visible or accessible. Instead, a user can easily locate and pull the second actuator pin from any orientation of the buckle assembly. Moreover, the secondary release mechanism that can be pulled relative to the buckle assembly to release the buckle assembly eliminates the need to provide any opposing force on the buckle assembly when actuating the primary push release button. For example, a user can easily pull the secondary release actuator with one hand, thereby leaving the user's other hand free for other tasks. Moreover the swivel subassemblies described herein also prevent twisting or misalignment of the corresponding webs.

From the foregoing, it will be appreciated that specific embodiments of the disclosure have been described herein for purposes of illustration, but that various modifications may be made without deviating from the spirit and scope of the various embodiments of the disclosure. Further, while various advantages associated with certain embodiments of the disclosure have been described above in the context of those embodiments, other embodiments may also exhibit such advantages, and not all embodiments need necessarily exhibit such advantages to fall within the scope of the invention. The following examples are directed to embodiments of the present disclosure.

We claim:

1. A personal restraint system for use in a vehicle, the personal restraint system comprising:

a connector configured to be coupled to a web, the connector having a tongue with an engagement portion; and a multi-release buckle assembly configured to releasably retain the tongue of the connector when the connector is inserted into the buckle assembly, the buckle assembly comprising— a frame having a tongue opening configured to receive the tongue when the tongue is inserted into the buckle assembly;

a locking member movable relative to the frame between a locked position and an unlocked position, wherein the locking member is configured to contact the engagement portion to retain the tongue in the buckle assembly when the locking member is in the locked position;

a release button movable relative to the frame toward a release position to urge the locking member from the locked position toward the unlocked position; and a release pull coupled to the release button, wherein the release pull is movable relative to the frame to urge the release button toward the release position, wherein the buckle assembly has a longitudinal axis and wherein the release button is movable generally parallel to the longitudinal axis and the release pull is movable generally perpendicular to the longitudinal axis.

2. The personal restraint system of claim 1 wherein the frame includes a locking member opening and the buckle assembly further comprises an alignment guide coupled to the frame, the alignment guide having guide channel generally aligned with the locking member opening, and wherein the locking member is movable relative to the frame between the locked and unlocked positions through at least a portion of each of the locking member opening and the guide channel.

3. The personal restraint system of claim 2 wherein the alignment guide further comprises first biasing extension spaced apart from a second biasing extension, wherein the first and second biasing extensions contact the release button and urge the release button away from the release position.

4. The personal restraint system of claim 1 wherein the buckle assembly further comprises a biasing member that urges the locking member toward the locked position, wherein the biasing member includes a first end portion opposite a second end portion, and wherein the first end portion is coupled to the locking member and the second end portion is coupled to the release button.

5. The personal restraint system of claim 1 wherein:

the release button includes an end portion spaced apart from the tongue opening, the end portion having a release pin surface, and wherein the buckle assembly further comprises— a support coupled to the frame adjacent to the end portion of the release button, the support having a release pull opening that intersects a release pin slot; and a release pin movably positioned in the release pin slot, wherein the release pin includes a first pin end portion coupled to the release pull and a second pin end portion opposite the first pin end portion, and wherein the second pin end portion slides through the release pin slot and against the release pin contact surface to urge the release button toward the release position as the release pull moves through the release pull opening away from the frame.

6. The personal restraint system of claim 5 wherein the release pin contact surface extends at an inclined angle relative to a longitudinal axis of the release button.

7. The personal restraint system of claim 1, further comprising:

a first cover;

a second cover coupled to the second cover, wherein the first and second covers house the frame and the locking member, and wherein the release button and the release pull are externally accessible from the first and second covers.

8. The personal restraint system of claim 7 wherein at least one of the first and second covers includes a web cutter carrying portion, and wherein the personal restraint system further comprises a web cutter removably carried by the web cutter carrying portion.

9. The personal restraint system of claim 1 wherein the web is a first web and wherein the buckle assembly further comprises a swivel connector configured to be coupled to a second web, wherein the swivel connector is coupled to the frame and configured to rotate relative to the frame.

10. A personal restraint system for use in a vehicle, the personal restraint system comprising:

a connector configured to be coupled to a web, the connector having a tongue with an engagement portion; and a multi-release buckle assembly configured to releasably retain the tongue of the connector when the connector is inserted into the buckle assembly, the buckle assembly comprising— a frame having a tongue opening configured to receive the tongue when the tongue is inserted into the buckle assembly;

a locking member movable relative to the frame between a locked position and an unlocked position, wherein the locking member is configured to contact the engagement portion to retain the tongue in the buckle assembly when the locking member is in the locked position;

a release button movable relative to the frame toward a release position to urge the locking member from the locked position toward the unlocked position; and a release pull coupled to the release button, wherein the release pull is movable relative to the frame to urge the release button toward the release position, wherein the release button includes a first sidewall opposite a second sidewall, and wherein each of the first and second sidewalls includes— a release feature having a sliding surface extending from a resting surface; and a locking feature spaced apart from the release feature, the locking feature having a locking surface; and the locking member includes a first locking extension opposite a second locking extension, and wherein— when the locking member is in the locked position, the first and second locking extensions are positioned between the corresponding resting and locking surfaces; and when the locking member moves from the locked position toward the unlocked position, the first and second locking extensions slide along at least a portion of the corresponding sliding surfaces.

11. The personal restraint system of claim 10 wherein:

the sliding surface is a first sliding surface, the resting surface is a first resting surface, and the locking surface is a first locking surface; and each of the first and second extensions include a second sliding surface extending from a second resting surface, and a second locking surface opposite the second resting surface, and wherein— when the locking member is in the locked position the second resting surface is adjacent the first resting surface and the second locking surface is adjacent the first locking surface; and when the locking member moves from the locked position toward the unlocked position the second sliding surface moves along at least a portion of the first sliding surface.

12. A personal restraint system for use in a vehicle, the personal restraint system comprising:

a connector configured to be coupled to a web, the connector having a tongue with an engagement portion; and a multi-release buckle assembly configured to releasably retain the tongue of the connector when the connector is inserted into the buckle assembly, the buckle assembly comprising— a frame having a tongue opening configured to receive the tongue when the tongue is inserted into the buckle assembly;

a locking member movable relative to the frame between a locked position and an unlocked position, wherein the locking member is configured to contact the engagement portion to retain the tongue in the buckle assembly when the locking member is in the locked position, wherein the frame includes first and second alignment projections extending into a locking member opening, and wherein the locking member includes first and second alignment grooves, wherein the first and second alignment projections are configured to contact the corresponding first and second alignment grooves as the locking member moves through the locking member opening;

a release button movable relative to the frame toward a release position to urge the locking member from the locked position toward the unlocked position; and a release pull coupled to the release button, wherein the release pull is movable relative to the frame to urge the release button toward the release position.

13. A connector and buckle assembly for use in a vehicle, the assembly comprising:

a web connector configured to be coupled to a web, the web connector having a tongue; and a buckle assembly configured to configured to releasably retain the tongue, the buckle assembly comprising— a frame;

a locking member movably carried by the frame and biased toward a locked position to retain the tongue in the buckle assembly when the tongue is inserted into the buckle assembly;

a first release actuator carried by the frame; and a second release actuator carried by the frame, wherein manipulation of at least one of the first actuator and the second actuator drives the locking member away from the locked position to release the tongue from the buckle assembly, wherein the buckle assembly has a longitudinal axis, and wherein:

the first release actuator is configured to be pushed in a direction generally parallel to the longitudinal axis to drive the locking member away from the locked position; and the second release actuator is configured to be pulled in a direction generally perpendicular to the longitudinal axis to drive the locking member away from the locked position.

14. The assembly of claim 13 wherein manipulation of the second release actuator moves the first release actuator to drive the locking member away from the locked position.

15. The assembly of claim 13 wherein the first release actuator includes a middle portion between a first end portion and a second end portion, and wherein:

the first end portion includes an exterior surface that is configured to be externally accessible for a user to depress the first release actuator to manipulate the first release actuator;

the middle portion includes— a locking surface that is configured to retain the locking member in the locked position; and a releasing surface that is configured to drive the locking member away from the locked position; and the second end portion includes an opening defining a contact surface, and wherein a release pin coupled to the second release actuator slides along at least a portion of the contact surface to move the first release actuator via the second release actuator.

16. The assembly of claim 13 wherein the buckle assembly further comprises an alignment guide between the frame and the first release actuator, the alignment guide having a guide channel and at least one biasing extension, wherein the locking member moves through the guide channel when the locking member moves away from the locked position, and wherein the biasing extension urges the first release actuator away from the frame.

17. The assembly of claim 16 wherein:

the alignment guide includes an alignment extension projecting from the biasing extension; and the frame includes an alignment recess that at least partially receives the alignment extension.

18. The assembly of claim 13 wherein the buckle assembly further comprises a support block coupled to the frame, and wherein the second release actuator moves through at least a portion of the support block to drive the locking member away from the locked position via the first locking member.

19. The assembly of claim 18 wherein the web is a first web and wherein the buckle assembly further comprises:

a swivel fastener coupled to the support block; and a swivel web connector coupled to the swivel fastener, wherein the swivel web connector is configured to be coupled to a second web and to rotate about the swivel connector.

20. A personal restraint system for use in a vehicle, the personal restraint system comprising:

a connector configured to be coupled to a web, wherein the connector includes a tongue; and a buckle assembly configured to releasably retain the tongue when the tongue is inserted into the buckle assembly, the buckle assembly comprising— means for receiving the tongue when the tongue is inserted into the buckle assembly;

means for retaining the tongue in the buckle assembly, the means for retaining being movable between a locked position to secure the tongue in the buckle assembly and an unlocked position to allow the tongue to be released from the buckle assembly;

first means for moving the means for retaining from the locked position toward the unlocked position; and second means for moving the means for retaining from the locked position toward the unlocked position, wherein the first means comprises a first release actuator that is configured to be pushed in a first direction that is generally parallel to a longitudinal axis of the buckle assembly to move the means for retaining the tongue from the locked position toward the unlocked position; and the second means comprises a second release actuator that is configured to be pulled in a second direction that is generally perpendicular to the longitudinal axis of the buckle assembly to move the means for retaining the tongue from the locked position toward the unlocked position.

21. The personal restraint system of claim 20 wherein the connector is a first connector configured to be coupled to a first web, and wherein the buckle assembly further comprises:

a second connector configured to be coupled to a second web; and means for rotating the second connector relative to the means for receiving the tongue.

22. The personal restraint system of claim 20 wherein the buckle assembly further comprises:

means for biasing the means for retaining the tongue toward the locked position; and means for guiding the means for retaining the tongue between the locked and unlocked positions.

23. The personal restraint system of claim 20 wherein when the second actuator is pulled in the second direction, the second actuator moves the first actuator in the first direction.

24. The personal restraint system of claim 20 wherein the buckle assembly further comprises:

a housing at least partially enclosing the means for receiving the tongue; and means for cutting the web, wherein the means for cutting the web is carried by the housing.

* * * * *